US012637849B2

(12) United States Patent
Khan

(10) Patent No.: US 12,637,849 B2
(45) Date of Patent: May 26, 2026

(54) STRATIFIED ELEVATION PROTECTIVE SINK SURFACE

(71) Applicant: Ruvati USA, Inc., Round Rock, TX (US)

(72) Inventor: Maruf Khan, Round Rock, TX (US)

(73) Assignee: Ruvati USA, Inc., Round Rock, TX (US)

( * ) Notice: Subject to any disclaimer, the term of this patent is extended or adjusted under 35 U.S.C. 154(b) by 0 days.

(21) Appl. No.: 18/640,959

(22) Filed: Apr. 19, 2024

(65) Prior Publication Data

US 2024/0352719 A1 Oct. 24, 2024

Related U.S. Application Data

(60) Provisional application No. 63/497,000, filed on Apr. 19, 2023.

(51) Int. Cl.
*E03C 1/186* (2019.01)

(52) U.S. Cl.
CPC ..... *E03C 1/186* (2013.01)

(58) Field of Classification Search
CPC .... A47K 1/04; A47K 1/12; E03C 1/12; E03C 1/14; E03C 1/16; E03C 1/18; E03C 1/186; B44C 1/22–28
See application file for complete search history.

(56) References Cited

U.S. PATENT DOCUMENTS

2008/0115267 A1 † 5/2008 Konno
2008/0148475 A1 6/2008 Lin
2009/0139023 A1 6/2009 Talerico

FOREIGN PATENT DOCUMENTS

CN 103844877 † 6/2014
CN 204218640 † 3/2015
(Continued)

OTHER PUBLICATIONS

A1 Cabinet and Granite, Kitchen Stainless Steel Available For wholesale, accessed Feb. 9, 2023, https://www.a1dmkitchen.com/stainless-steel-sinks.

(Continued)

*Primary Examiner* — Erin Deery
(74) *Attorney, Agent, or Firm* — Thompson Patent Law Offices PC

(57) ABSTRACT

Apparatus and associated methods relate to a stratified elevated protective sink surface. In an illustrative example, the sink may include a stratified protective surface extending along at least one face of a sink. The stratified protective surface may include a visually exposed protected stratum; and, a pattern protruding from the protected surface to form an elevated stratum extending across the stratified protective surface, and configured to support cookware elevated from the protected surface. At least thirty percent of the surface area of the underlying surface may include a stratified protective surface. Some embodiments may include a continuous pattern configured to interrupt scratching. The elevated stratum may include an interrupted pattern configured to prevent direct contact from objects, e.g., pots, utensils, pans, etc., protecting the underlying surface. Various embodiments may advantageously include the continuous pattern enclosing the interrupted pattern, protecting the interrupted pattern and the underlying surface from wear and tear.

20 Claims, 30 Drawing Sheets

(56) References Cited

FOREIGN PATENT DOCUMENTS

| | | | | | |
|---|---|---|---|---|---|
| CN | 206026015 | | † | 3/2017 | |
| CN | 117051925 | A | * | 11/2023 | ..... E03C 1/18 |
| FR | 1453704 | A | | 6/1966 | |
| JP | H0223333 | A | | 1/1990 | |
| JP | 2010042575 | A | * | 2/2010 | |
| JP | 2012052290 | A | | 3/2012 | |
| KR | 20030000264 | A | | 1/2003 | |
| KR | 200430726 | Y1 | | 11/2006 | |

OTHER PUBLICATIONS

Addis, Addis Kitchen Sink Mat Sink Scratch Protector Anti Slip Mat Drainer 40X30CM, accessed Feb. 9, 2023, https://www.ebay.com/itm/222994360655.

Google, Title: Etching stainless steel decorative plate process—foshanisatis, accessed Feb. 9, 2023, https://www.google.com/imgres.

Havens Luxury Metals, Heritage Undermount Sink—Prestige Stainless, accessed Feb. 9, 2023, https://havensmetal.com/products/heritage-stainless-sink-prestige.

HexClad, Elevated cooking. Easy cleanup. Cookware that lasts. discover HexClad science, accessed Feb. 9, 2023, https://hexclad.com/pages/hexclad-science.

Kohler, Kohler Tailor Large Single Basin Stainless Steel Sink with Etched Stone Insert, accessed Feb. 9, 2023, https://www.wayfair.com/home-improvement/pdp/kohler-tailor-large-single-basin-stainless-steel-sink-with-etched-stone-insert-lbpr2796.html.

Kraus, Outlast MicroShield 31½" Undermount 16 Gauge Stainless Steel Single Bowl Kitchen Sink, acessed Feb. 9, 2023, https://www.kraususa.com/kraus-kbu14e-31-12-undermount-16-gauge-stainless-steel-single-bowl-kitchen-sink.html.

Rachiele, Custom Stainless Steel Sinks, accessed Feb. 9, 2023, https://rachiele.com/about-stainless.

Stanch, Etching Finish Stainless Steel Sheets | 304/304L/316L/430 Grade—Stanch, accessed Feb. 9, 2023, https://www.stanch.com/etched-finish-stainless-steel-sheet.htm.

Zuhne, Zuhne 440×440 mm Stainless Steel Single Bowl Kitchen Sink for Flush, Inset or Under Mount Installation, accessed Feb. 9, 2023, https://zuhne.com/products/zuhne-440-x-440-mm-stainless-steel-single-bowl-kitchen-sink-for-flush-inset-or-under-mount-installation.

* cited by examiner
† cited by third party

STRATIFIED ELEVATION PROTECTIVE SINK SURFACE

CROSS-REFERENCE TO RELATED APPLICATIONS

This application is a continuation-in-part and claims the benefit of U.S. Design application Ser. No. 29/874,390, titled "Rinse Basin," filed by Maruf Khan, on Apr. 19, 2023.

This application claims the benefit of U.S. Provisional Application Ser. No. 63/497,000, titled "Stratified Elevation Protective Sink Surface," filed by Maruf Khan on Apr. 19, 2023.

This application incorporates the entire contents of the foregoing applications herein by reference.

TECHNICAL FIELD

Various embodiments relate generally to sinks, water basins, and kitchen appliances.

BACKGROUND

Kitchen sinks, essential for dishwashing, food preparation, and cleaning, are made from materials like stainless steel, porcelain, and composites, chosen for durability and ease of maintenance.

Design variations in kitchen sinks include single and double basins, with features such as integrated drainboards. Innovations have introduced deeper basins, noise-reduction coatings, and bacterial resistance to enhance functionality and hygiene.

Advancements in technology and shifting home design trends have refined kitchen sinks, optimizing water use and integrating waste disposal systems, such as garbage disposals, while focusing on aesthetic appeal in modern home decor.

SUMMARY

Apparatus and associated methods relate to a stratified elevated protective sink surface. In an illustrative example, the sink may include a stratified protective surface extending along at least one face of a sink. The stratified protective surface may include a visually exposed protected stratum; and, a pattern protruding from the protected surface to form an elevated stratum extending across the stratified protective surface, and configured to support cookware elevated from the protected surface. At least thirty percent of the surface area of the underlying surface may include a stratified protective surface. Some embodiments may include a continuous pattern configured to interrupt scratching. The elevated stratum may include an interrupted pattern configured to prevent direct contact from objects, e.g., pots, utensils, pans, etc., protecting the underlying surface. Various embodiments may advantageously include the continuous pattern enclosing the interrupted pattern, protecting the interrupted pattern and the underlying surface from wear and tear.

In some embodiments the sink may, for example, include an elevated stratum including a continuous pattern protruding from the protected surface, extending across the stratified protective surface, and configured to support cookware elevated from the protected surface; and, an interrupted pattern protruding from the protected surface, extending across the stratified protective surface interspersed with the first continuous pattern.

In some embodiments, the sink may, for example, include a continuous pattern including a hexagonal pattern remaining after etching the stratified protective surface to form the visually exposed protected stratum. The stratified protective sink may, for example, include an interrupted elevated pattern extending along three lines bisecting the hexagonal pattern.

In some embodiments, the interrupted pattern may, for example, include protrusions each having a surface area in the elevated stratum at least fifty percent of a cross-sectional area at the base. The surface area in the elevated stratum may, for example, include at least eighty percent of the cross-sectional area at the base.

In some embodiments, the stratified protective sink of claim 9, may, for example, include walls intersecting with the stratified protective surface to form an intersecting area; and a predetermined border along the protective surface extending from the intersecting area to the first continuous elevated polygon patterned etching. The stratified protective sink may, for example, include, the interrupted pattern including protrusions configured to have a flat uppermost surface. The stratified protective sink may, for example, include protrusions of the second non-continuous elevated pattern further including a predetermined spacing between protrusions. The sink may, for example, include visually exposed protected stratum including an etched depressed pattern of the stratified protective surface. The sink may, for example, include a continuous pattern including a circular pattern. The sink may, for example, include a predetermined graphic.

Various embodiments may achieve one or more advantages. For example, some embodiments may include irregular shapes, polygons (e.g., hexagon, pentagon, octagon), honeycomb, and/or circular patterned etching in the first continuous elevated pattern, each designed to cover at least 80% of the protective surface, which significantly reduces the exposure of the base material to potential damage. Additionally, the second non-continuous elevated patterned etching, strategically placed along lines that bisect the first pattern, includes protrusions that may, for example, have a rounded, smooth surface and predetermined spacing to further minimize the risk of scratches. These protrusions may, for example, be dull, reducing the likelihood of causing injury during use. Some embodiments, may, for example, use layered patterns between the first continuous pattern and the second non-continuous pattern and the use of chemical etching in the manufacturing process to provide a robust, aesthetically pleasing, and long-lasting sink surface, suitable for a variety of residential and commercial applications. In some embodiments, the first continuous elevated pattern may, for example, include a predetermined etching. The predetermined etching may, for example, include graphics (e.g., combination of patterns, flowers, birds, tigers, eagles, nature background, and/or other graphical representations).

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1A:
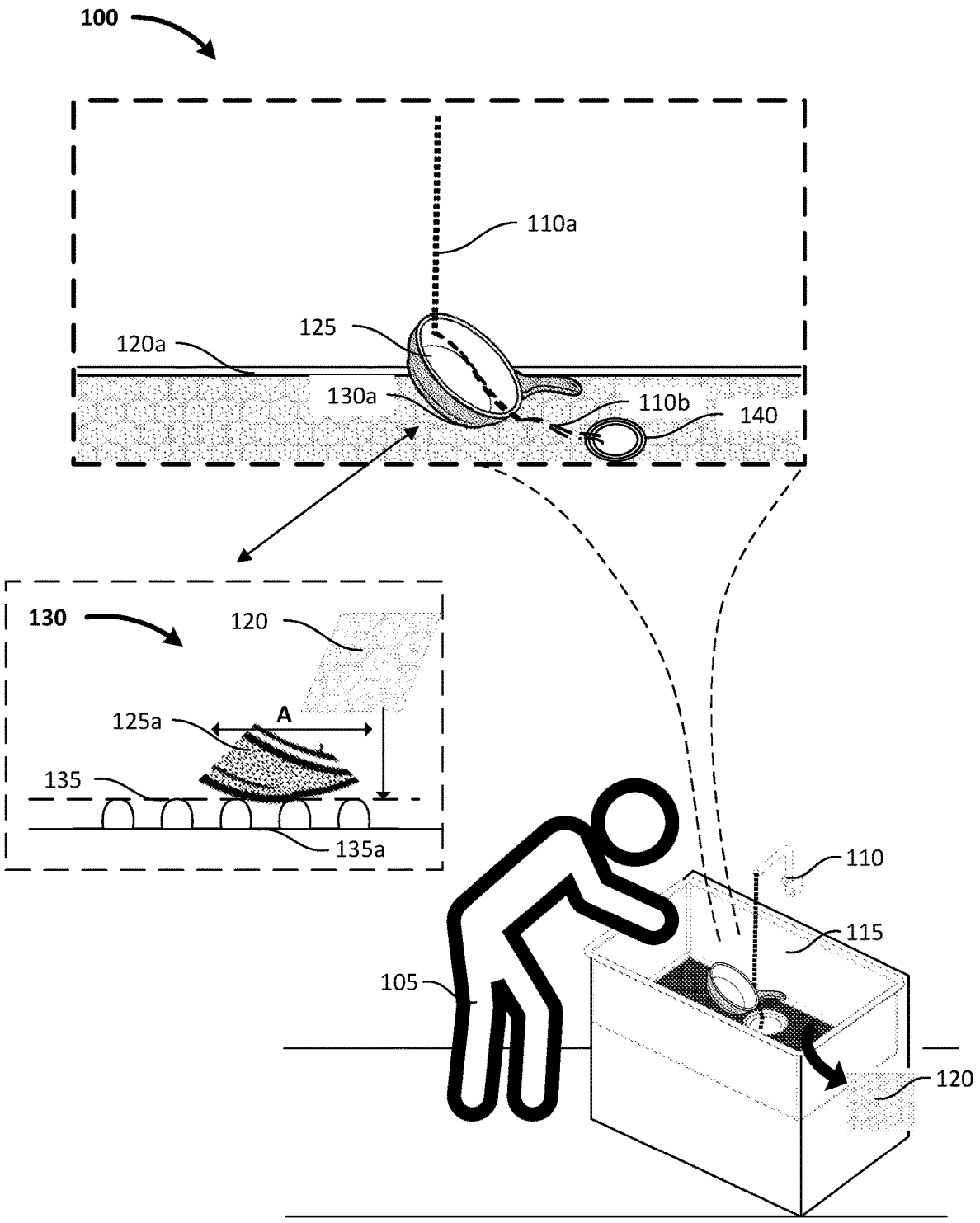
FIG. 1A depicts an exemplary use case scenario of a stratified elevation protective sink surface (SEPSS) employed in an illustrative use-case scenario.
Figure 1B:
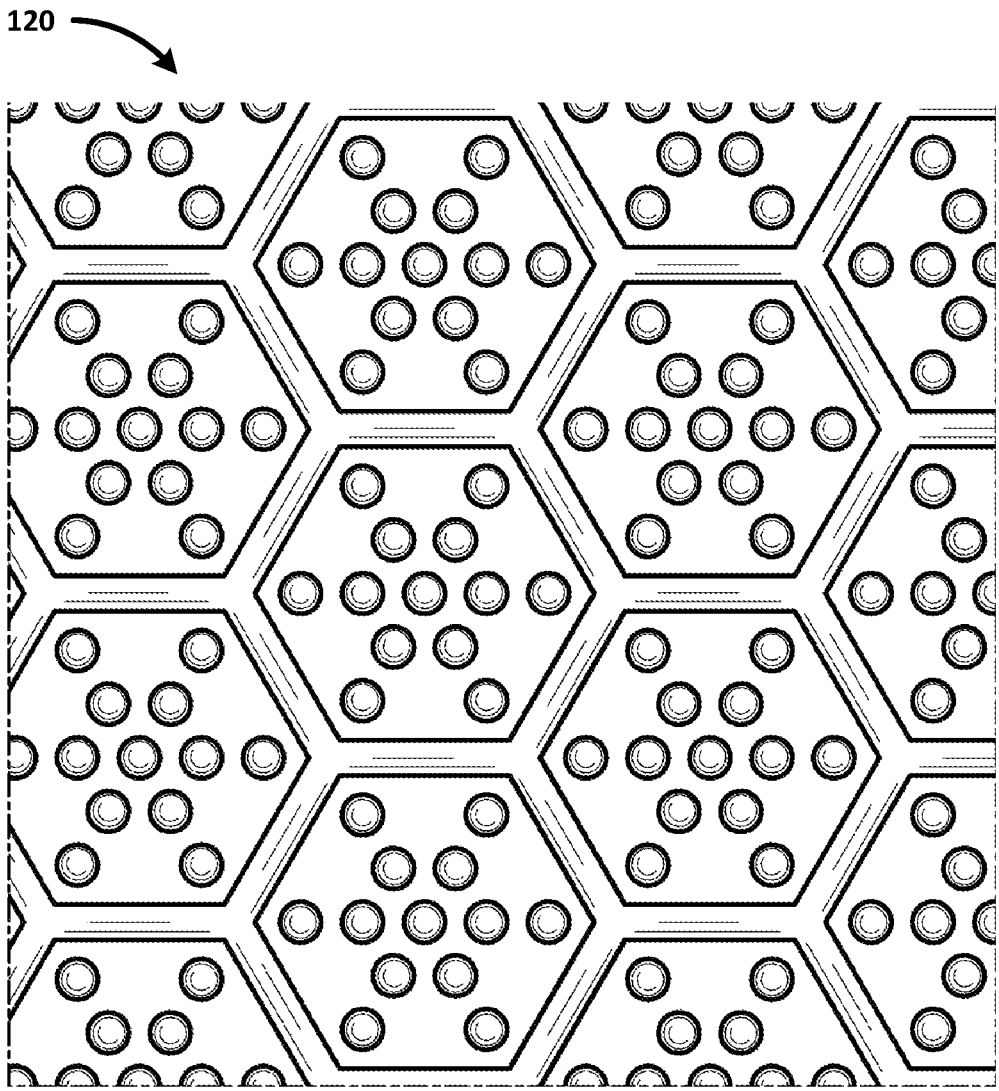
FIG. 1B depicts a close-up view of an exemplary SEPSS.
Figure 1C:
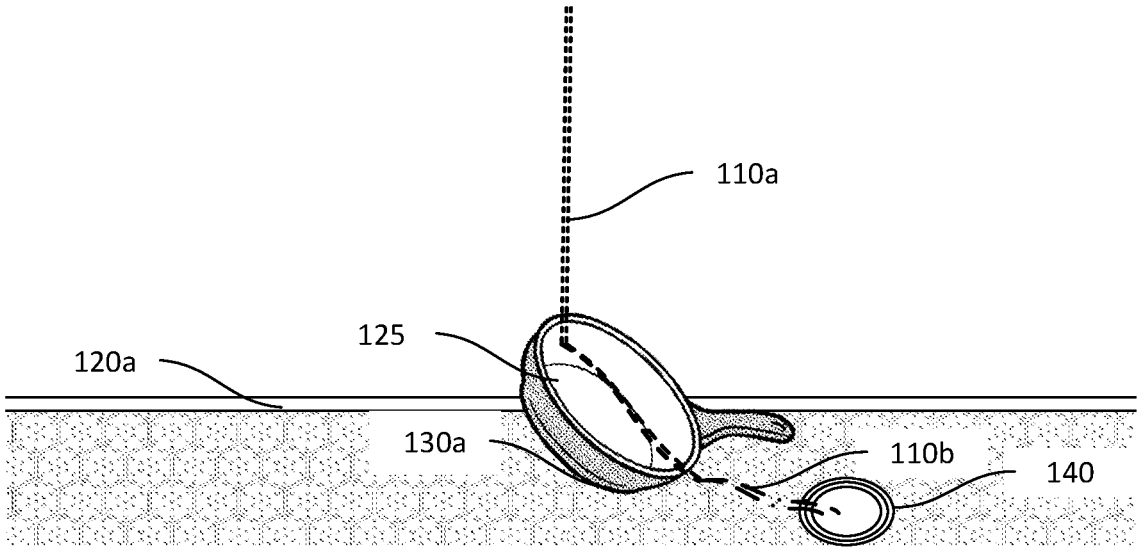
FIG. 1C depicts a close-up view of the illustrative use-case scenario including the SEPSS.
Figure 1D:
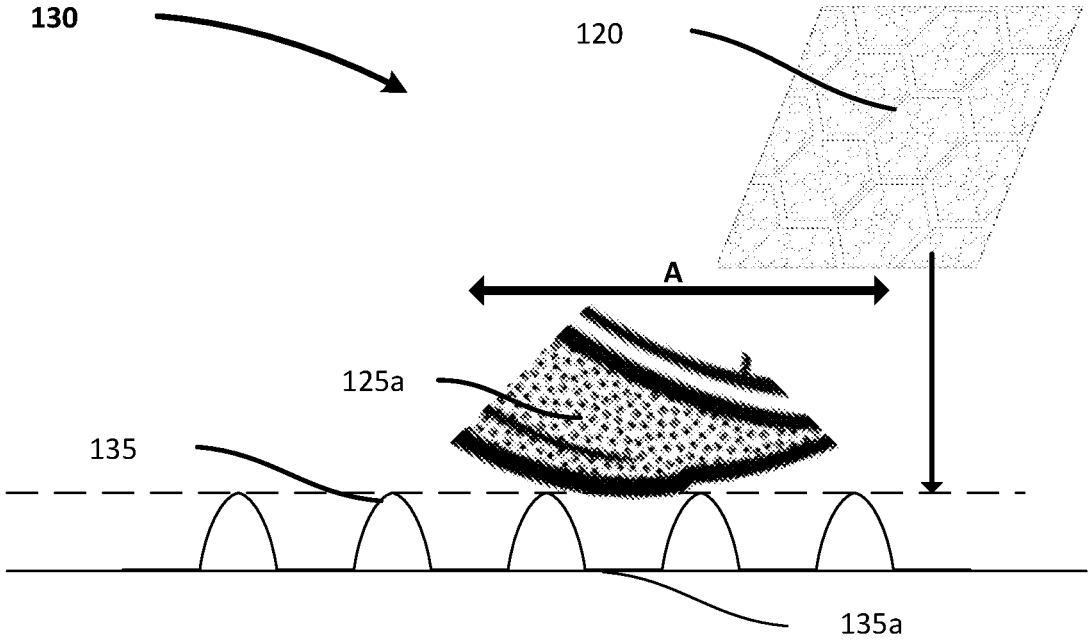
FIG. 1D depicts a close-up view of an exemplary schematic of the SEPSS in the use case scenario.
Figure 2A:
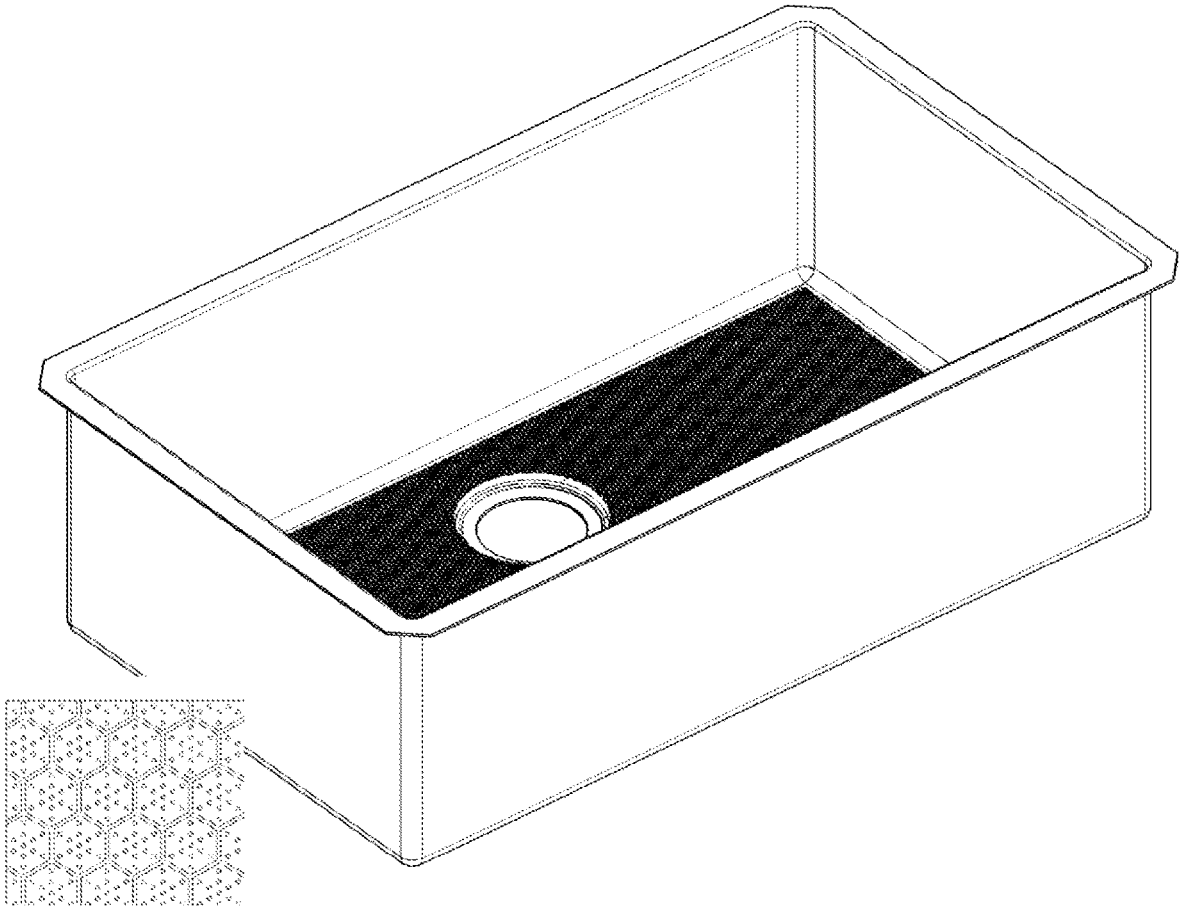
FIG. 2A depicts a top perspective view of an exemplary SEPSS.
Figure 2B:
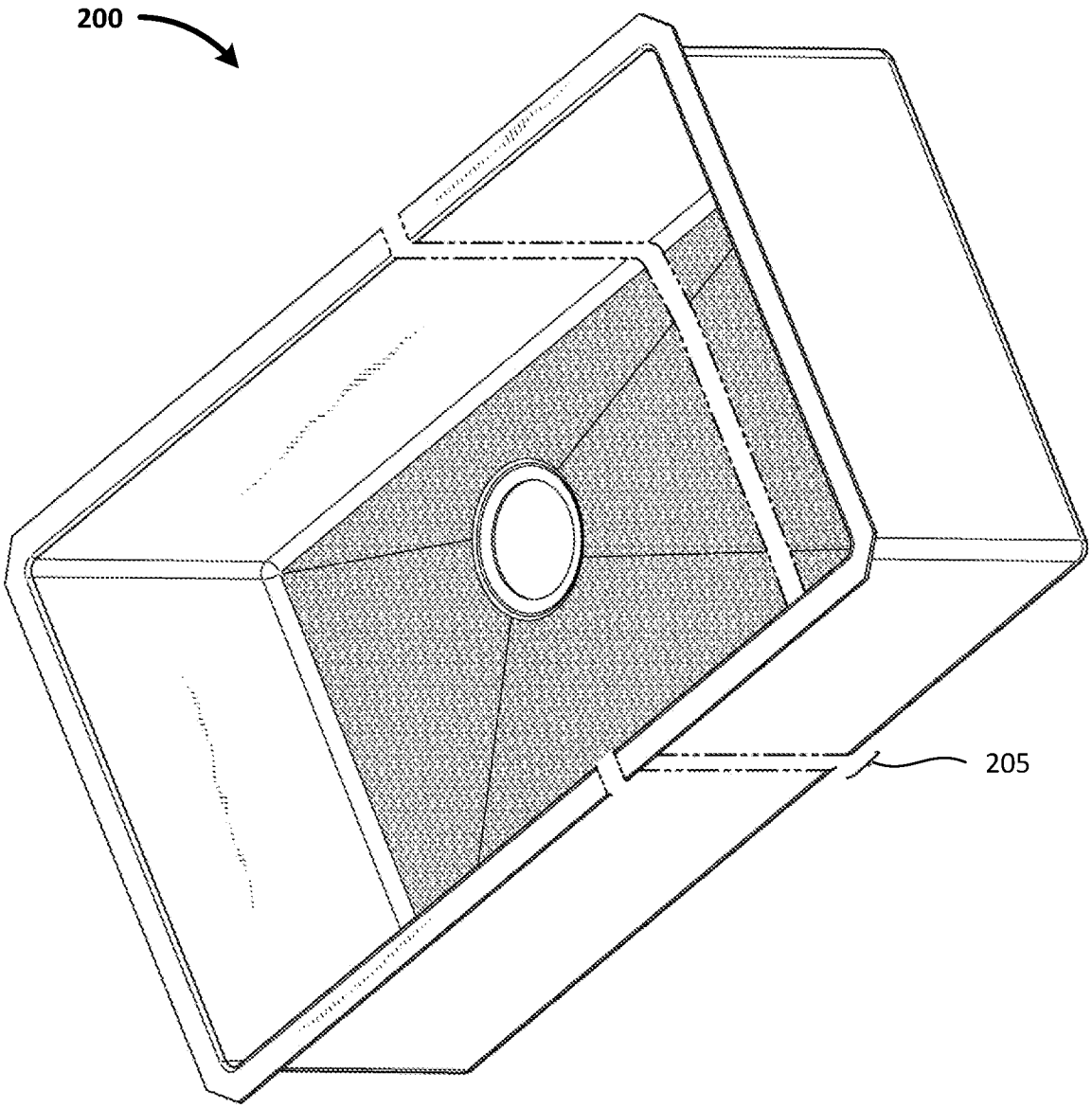
FIG. 2B depicts a top perspective view of an exemplary SEPSS with varying dimensions.
Figure 2C:
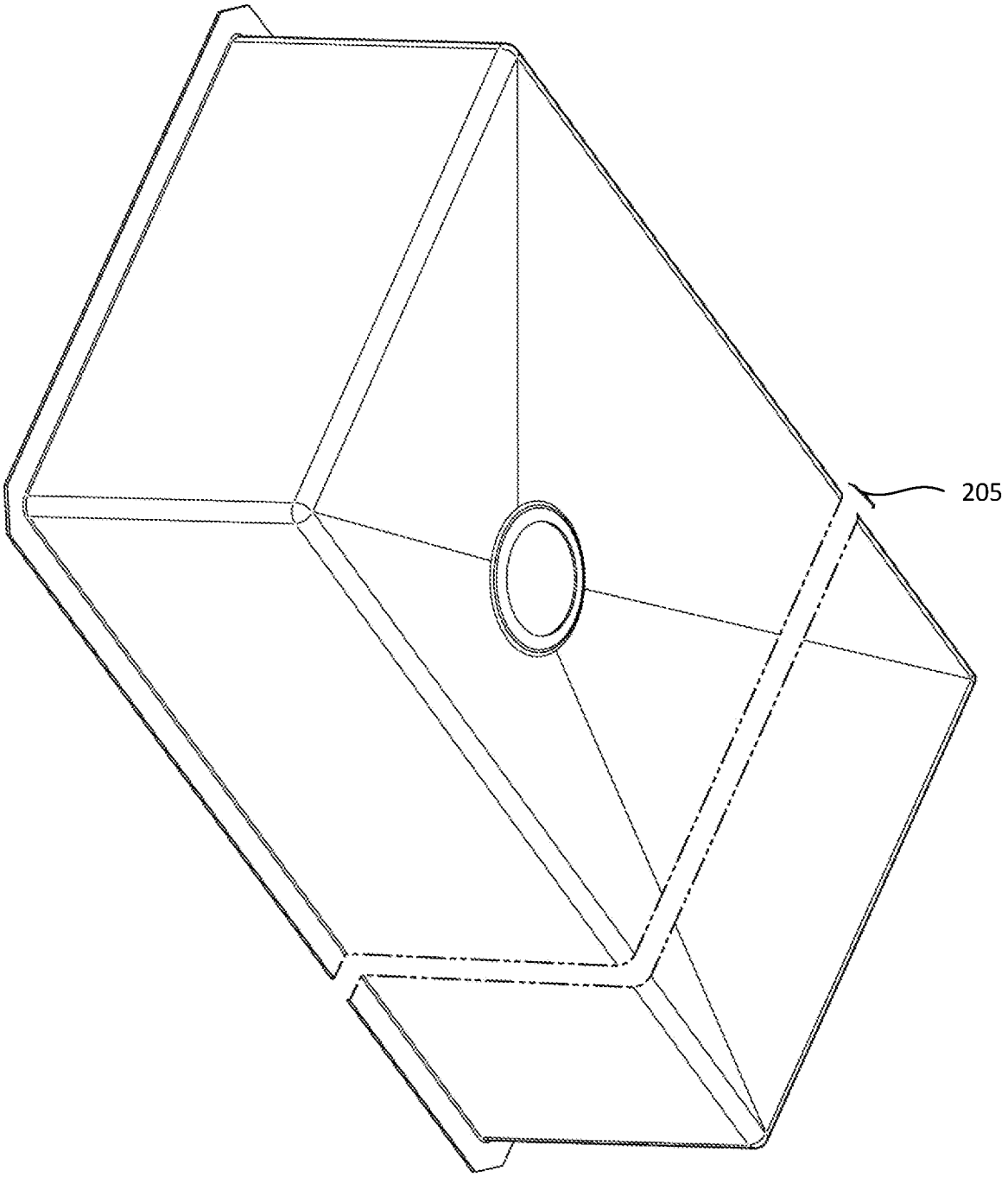
FIG. 2C depicts a bottom perspective view of an exemplary SEPSS with varying dimensions.
Figure 2D:
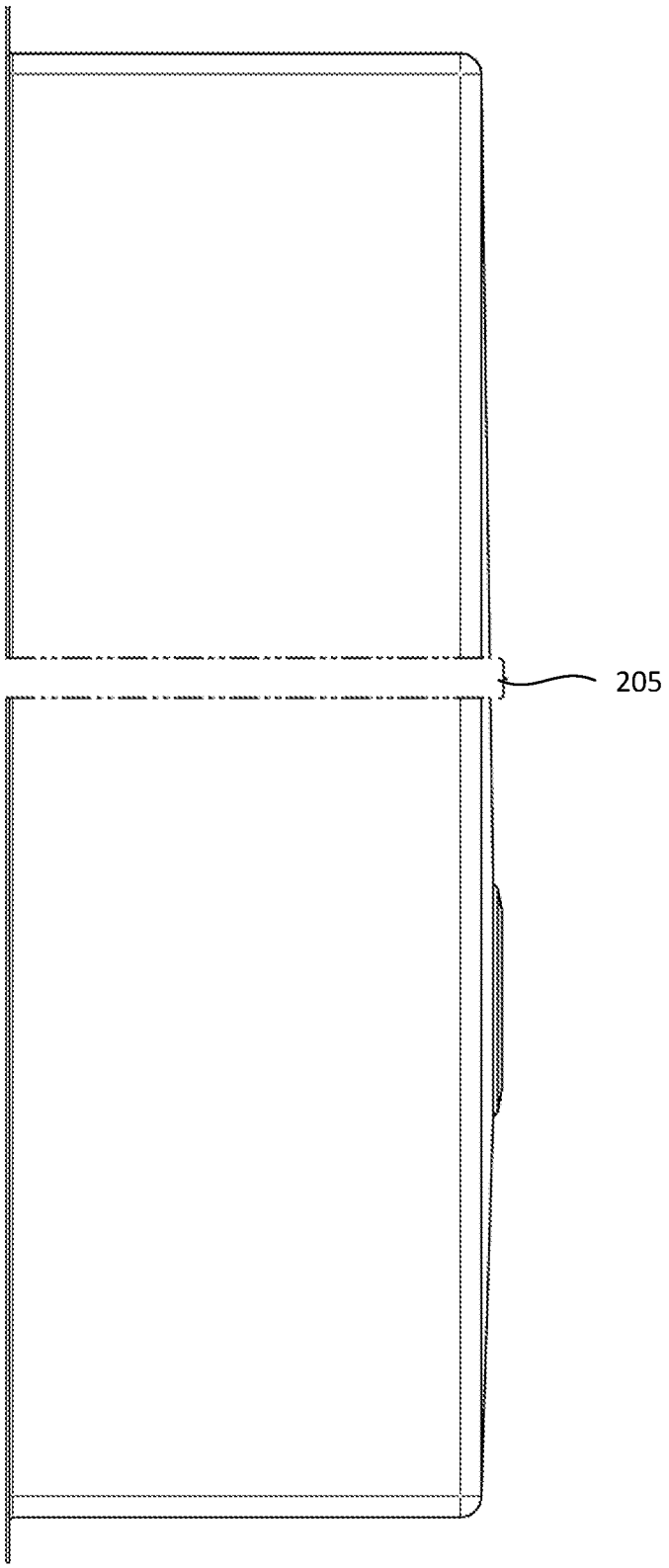
FIG. 2D depicts a front view of an exemplary SEPSS with varying dimensions.
Figure 2E:
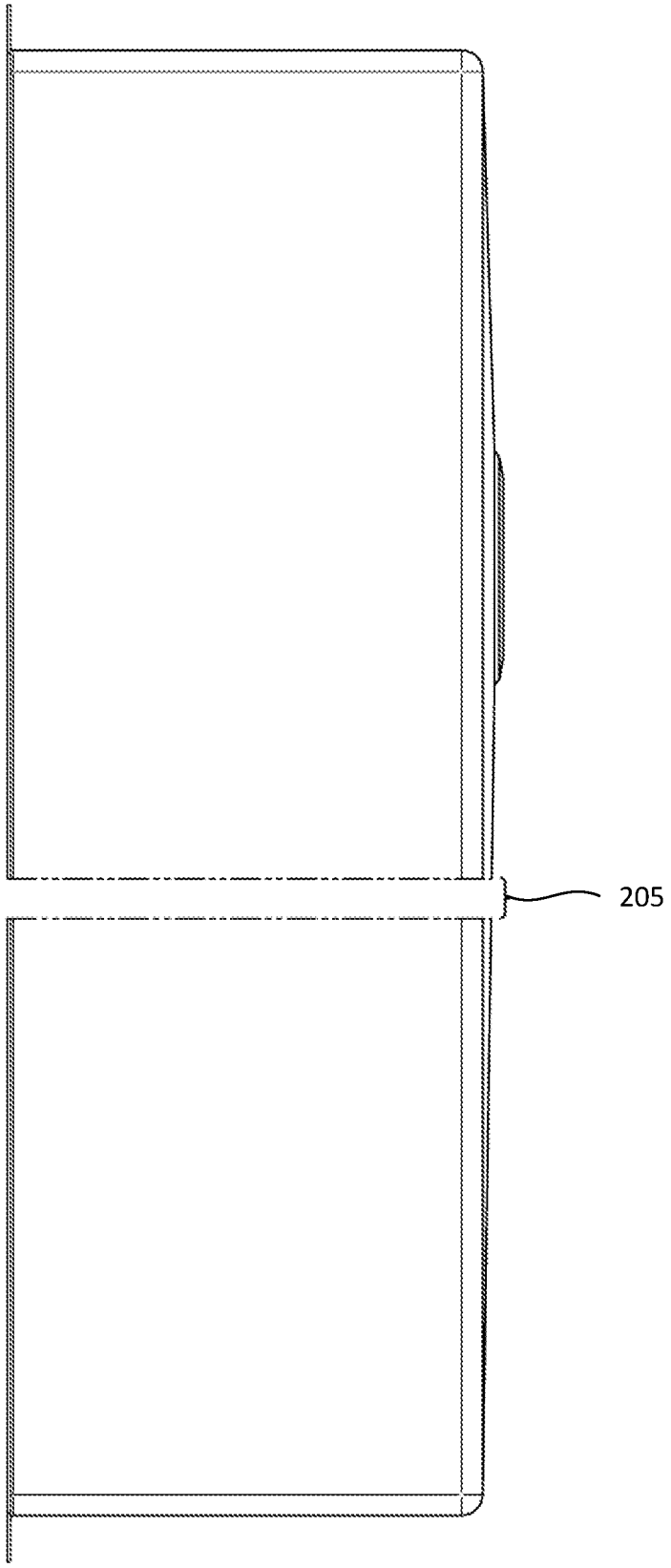
FIG. 2E depicts a back perspective view of an exemplary SEPSS with varying dimensions.
Figure 2F:
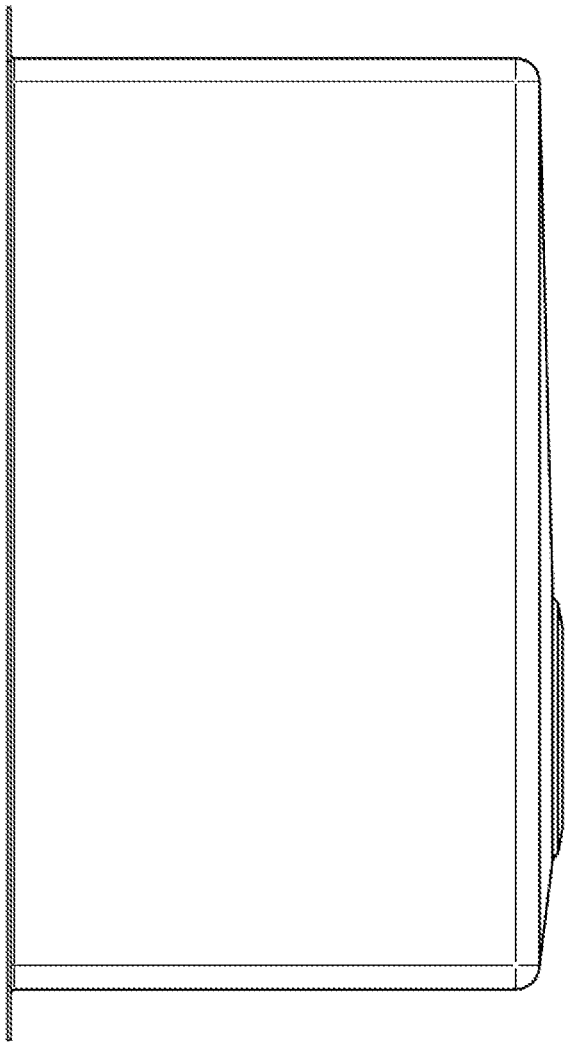
FIG. 2F depicts a left side view of an exemplary SEPSS with varying dimensions.
Figure 2G:
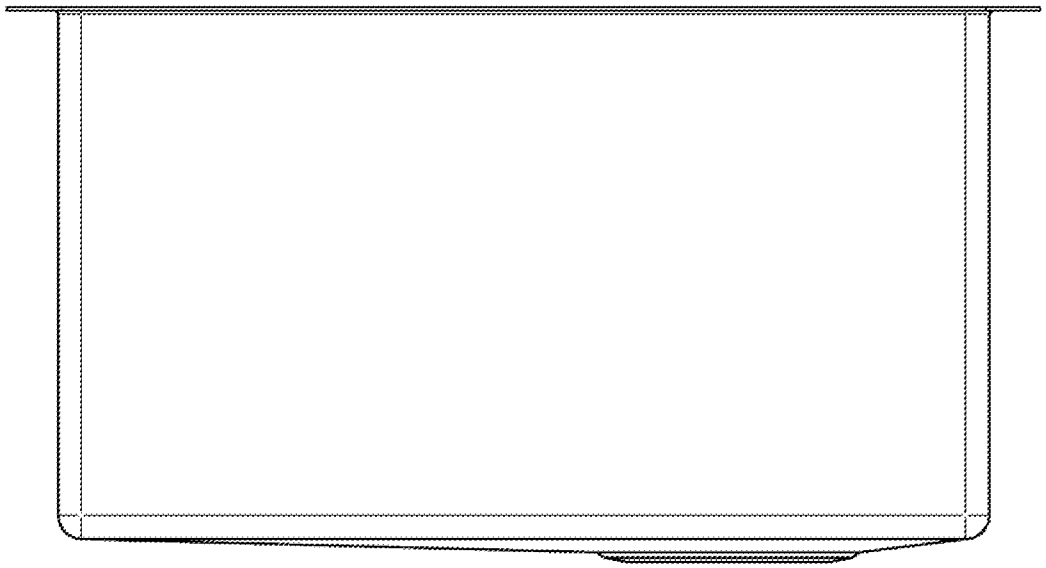
FIG. 2G depicts a right-side view of an exemplary SEPSS with varying dimensions.
Figure 2H:
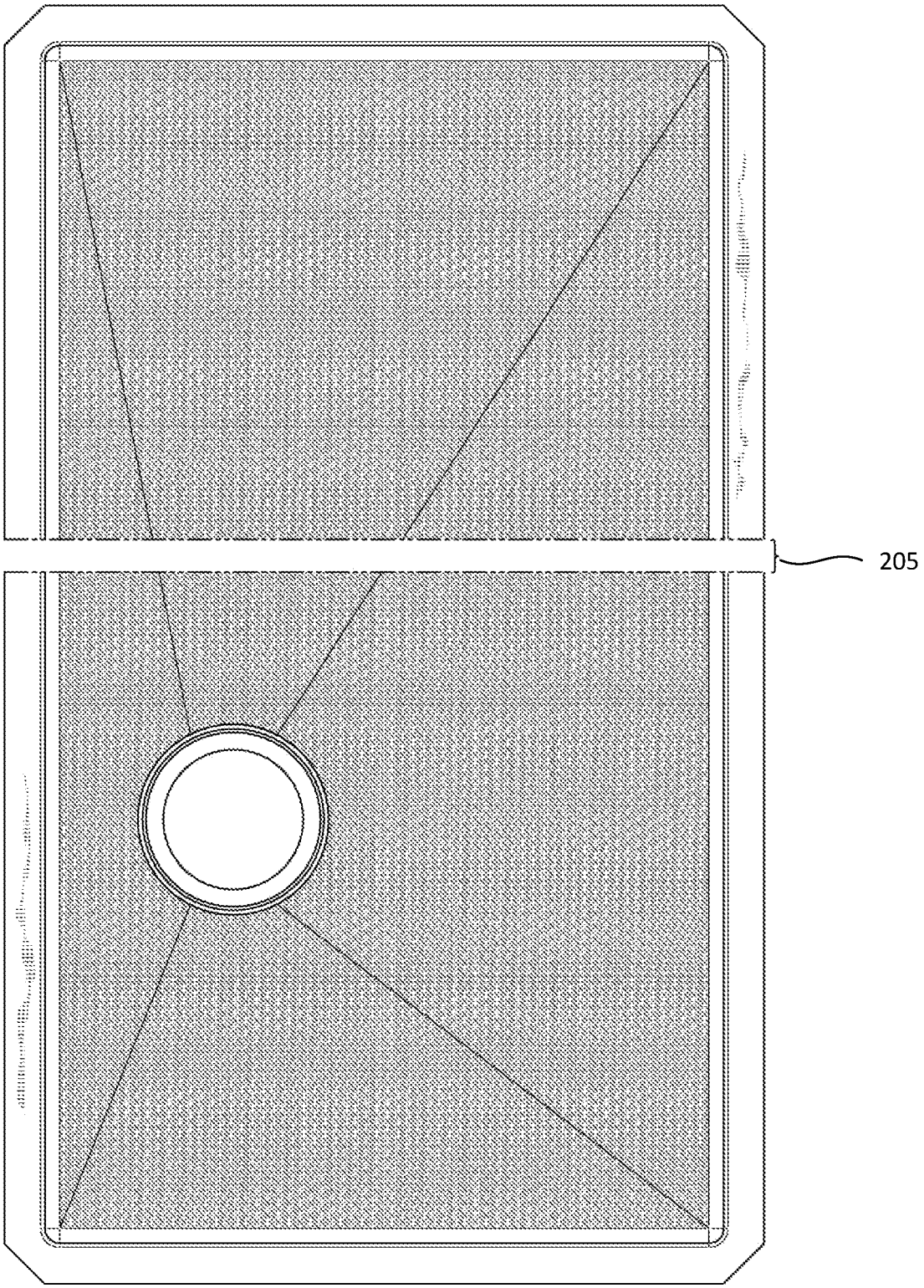
FIG. 2H depicts a top view of an exemplary SEPSS with varying dimensions.
Figure 2J:
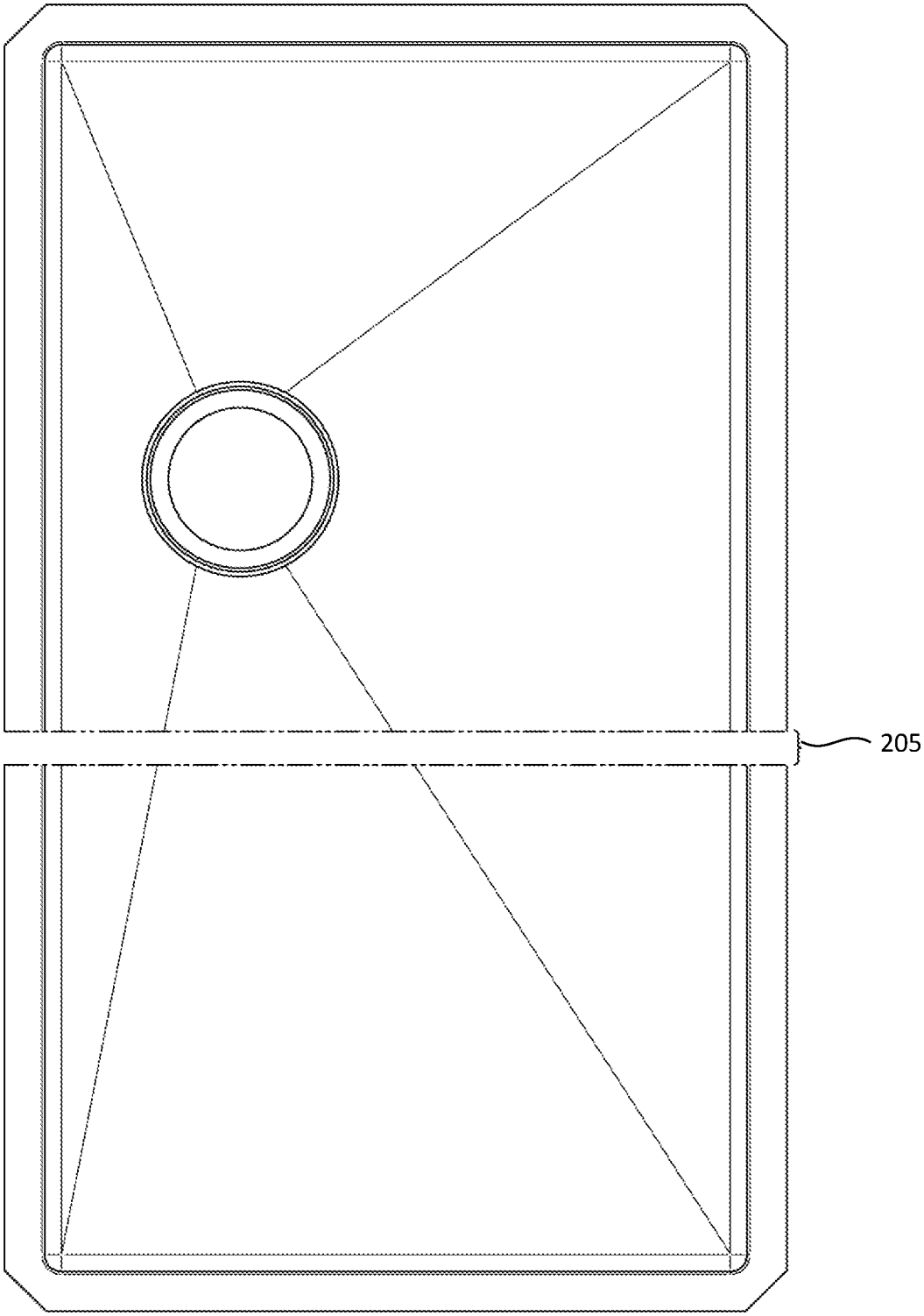
FIG. 2J depicts a bottom view of an exemplary SEPSS with varying dimensions.
Figure 3A:
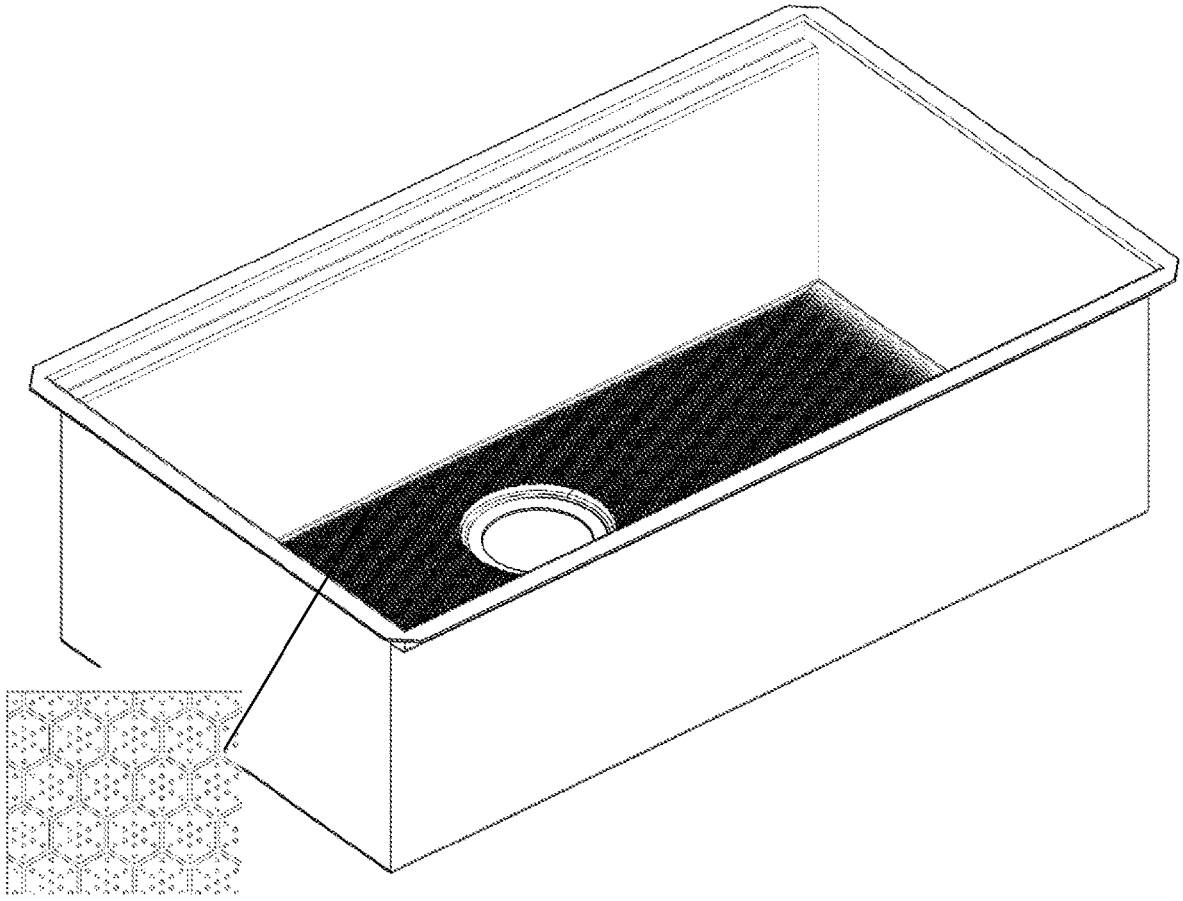
FIG. 3A depicts a perspective view of an exemplary SEPSS.
Figure 3B:
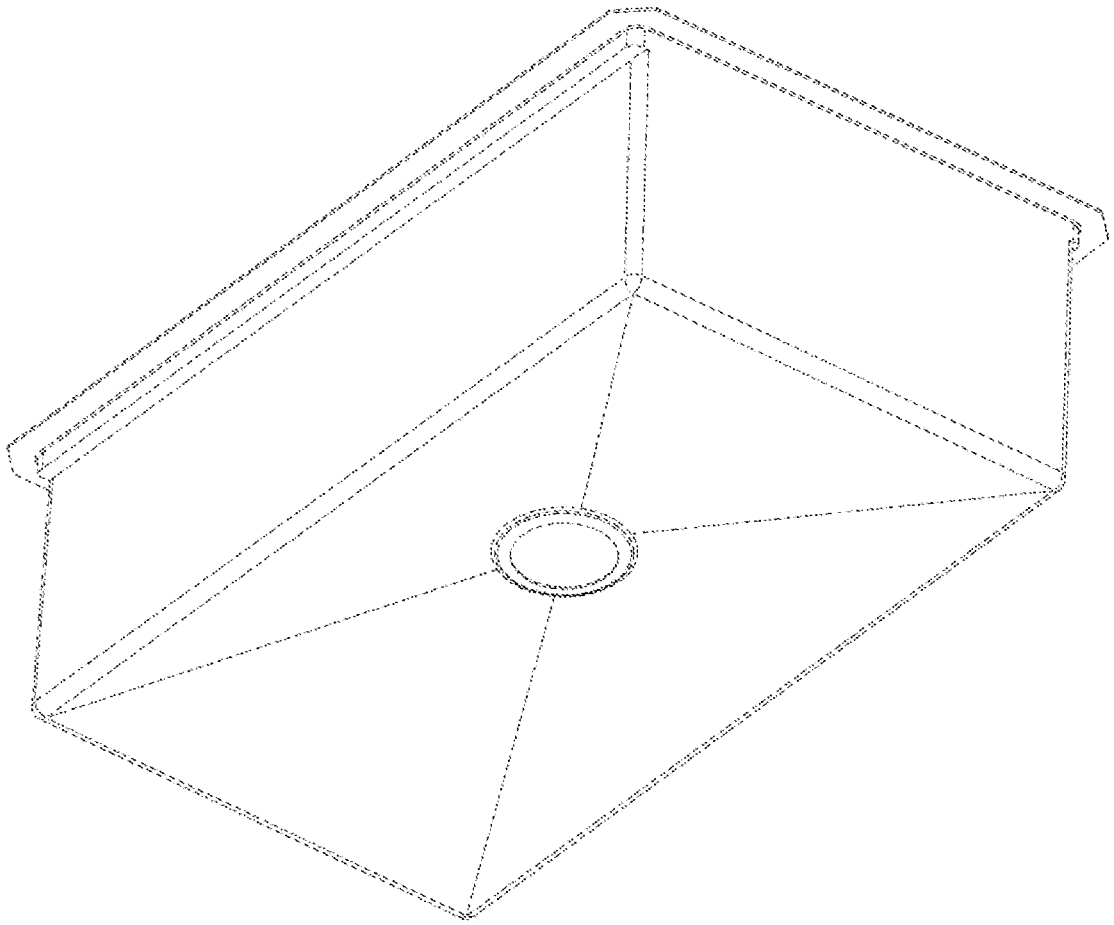
FIG. 3B depicts a bottom perspective view of an exemplary SEPSS.
Figure 3C:
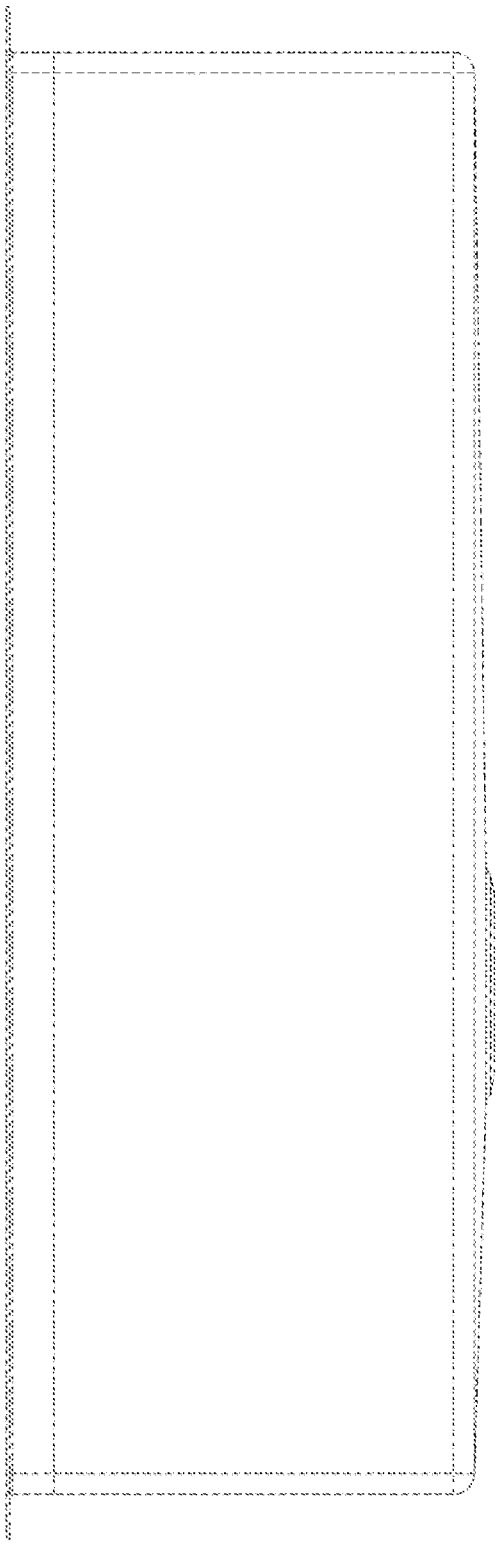
FIG. 3C depicts a front view of an exemplary SEPSS with varying dimensions.
Figure 3D:
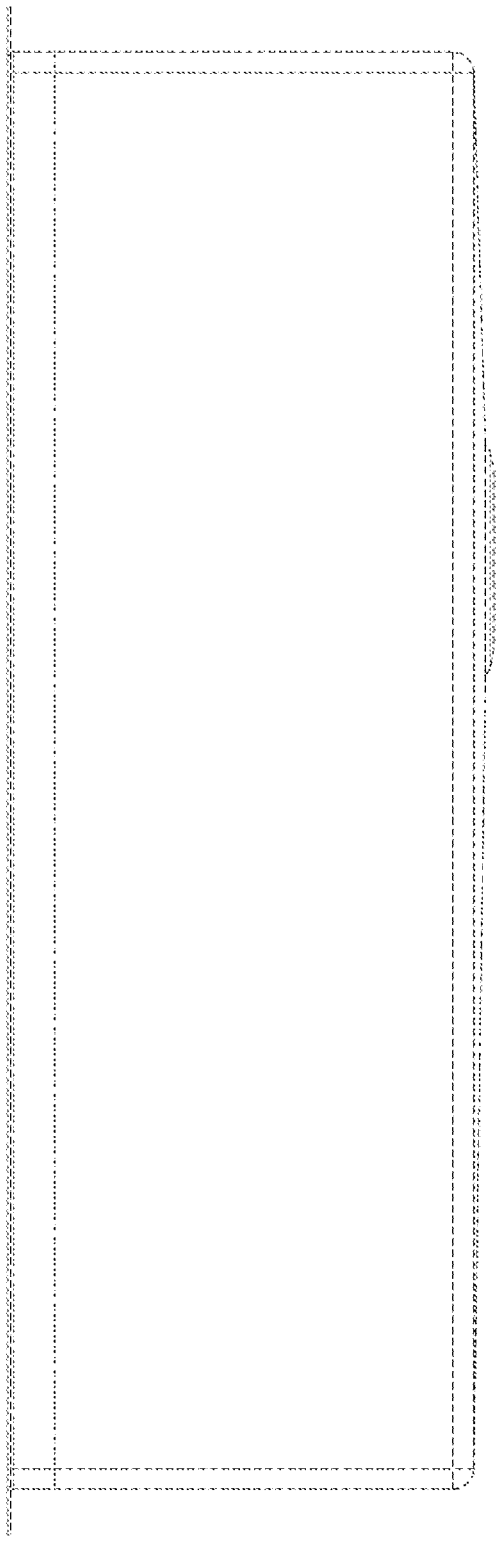
FIG. 3D depicts a back perspective view of an exemplary SEPSS.
Figure 3E:
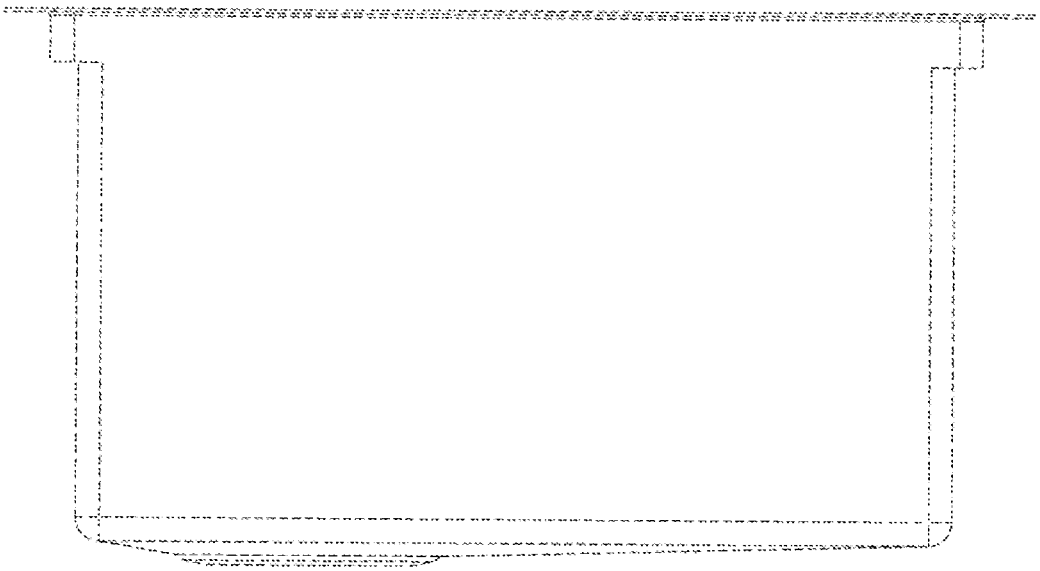
FIG. 3E depicts a left side view of an exemplary SEPSS.
Figure 3F:
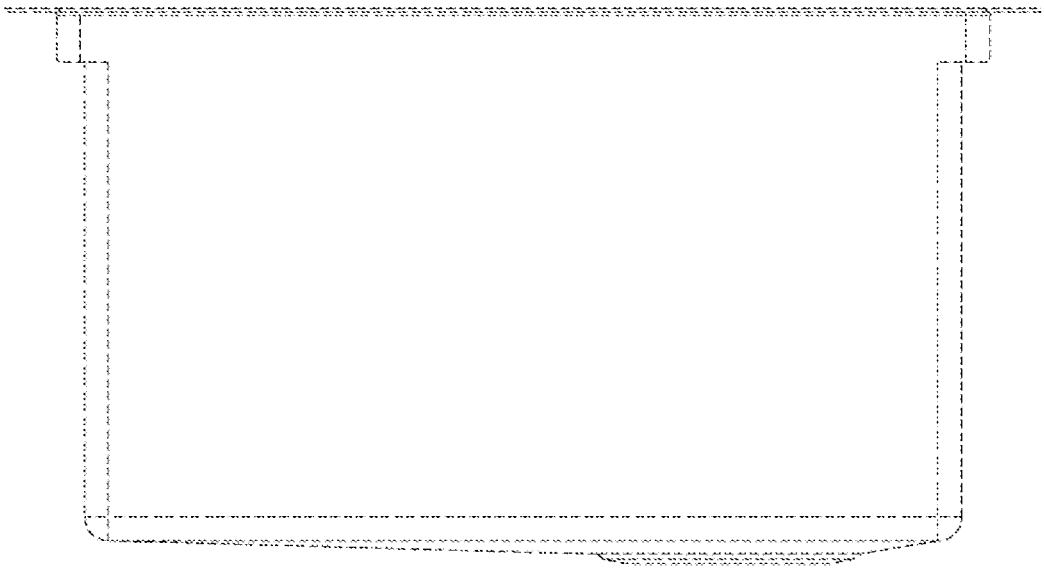
FIG. 3F depicts a right-side view of an exemplary SEPSS.
Figure 3G:
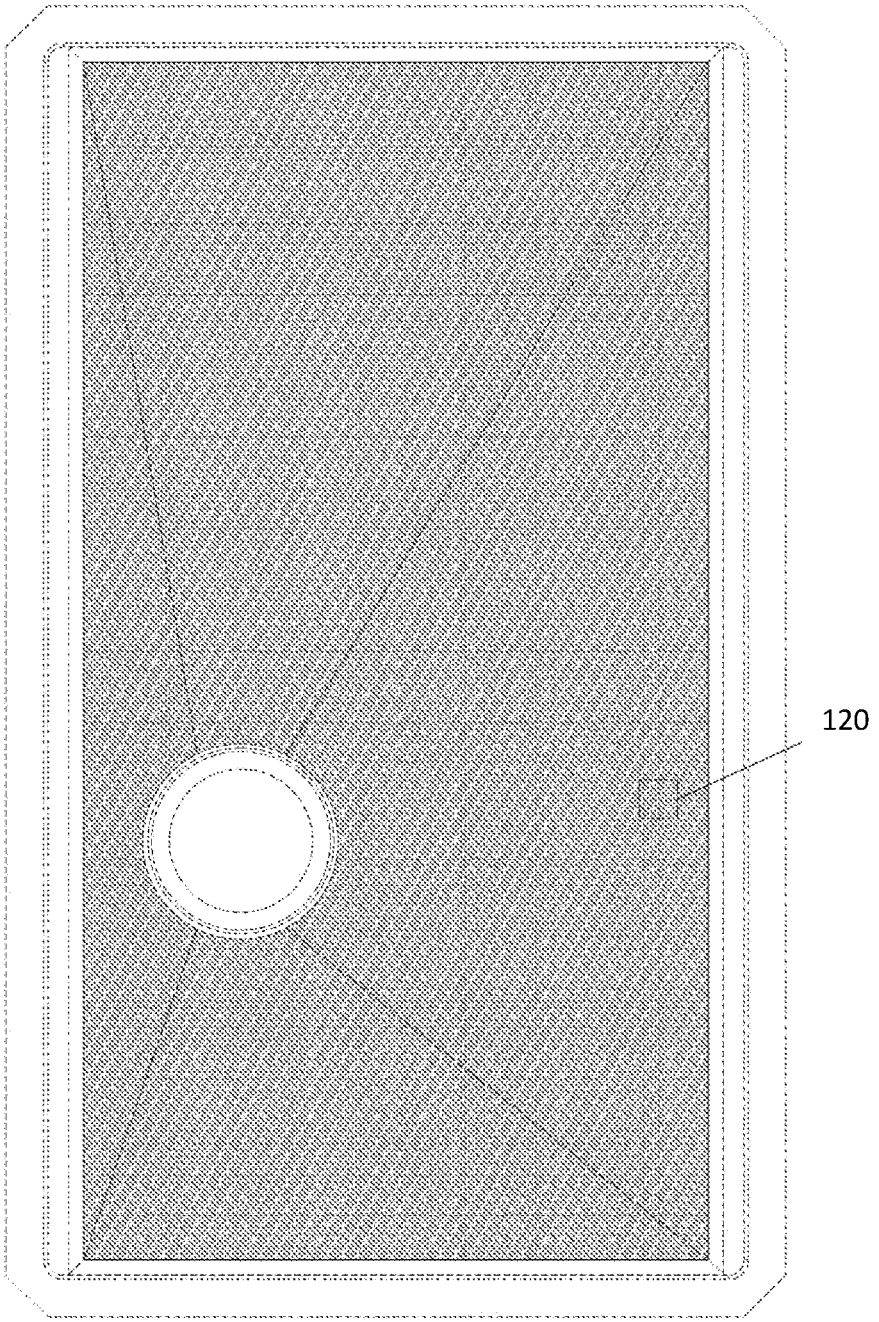
FIG. 3G depicts a top view of an exemplary SEPSS.
Figure 3H:
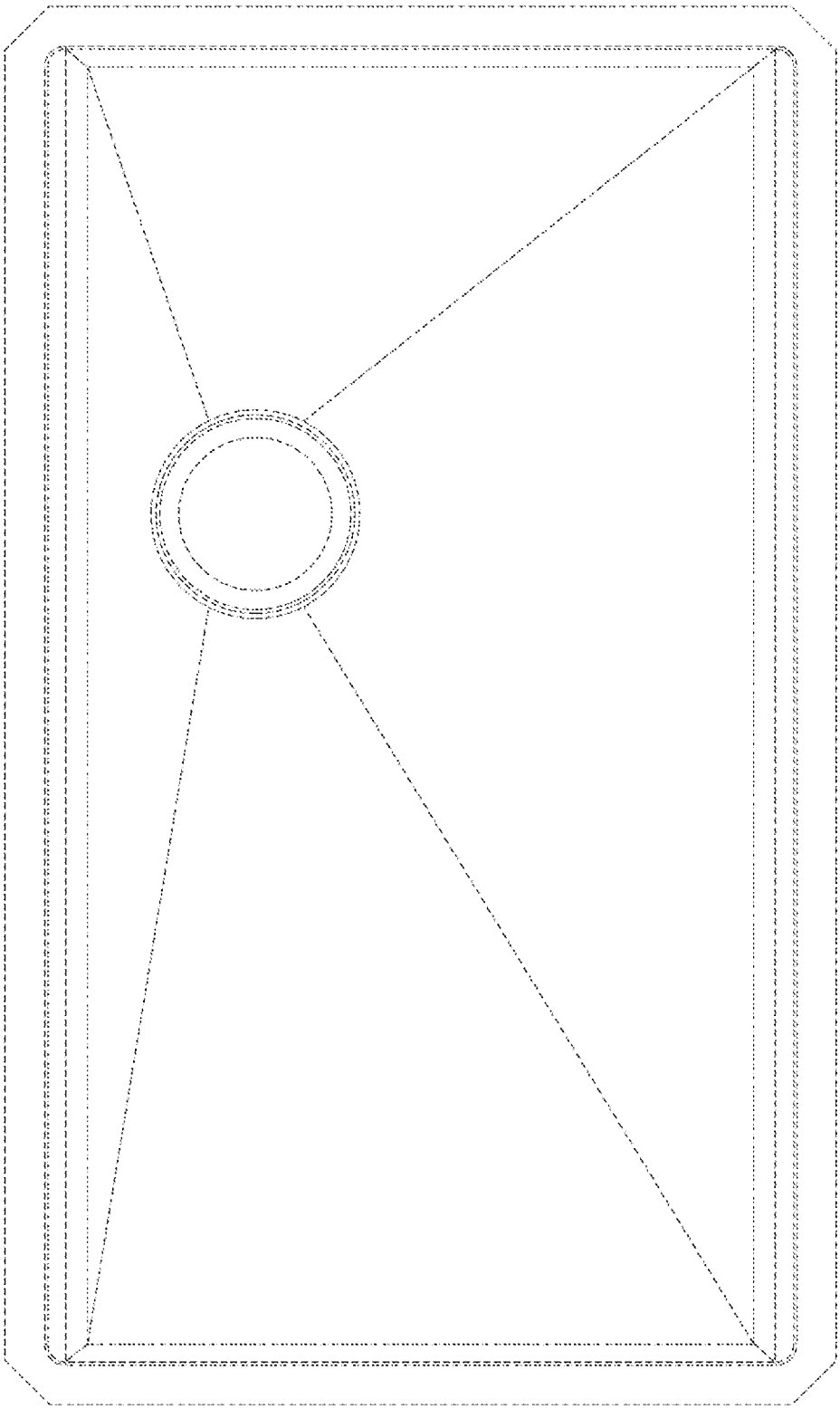
FIG. 3H depicts a bottom view of an exemplary SEPSS.
Figure 4A:
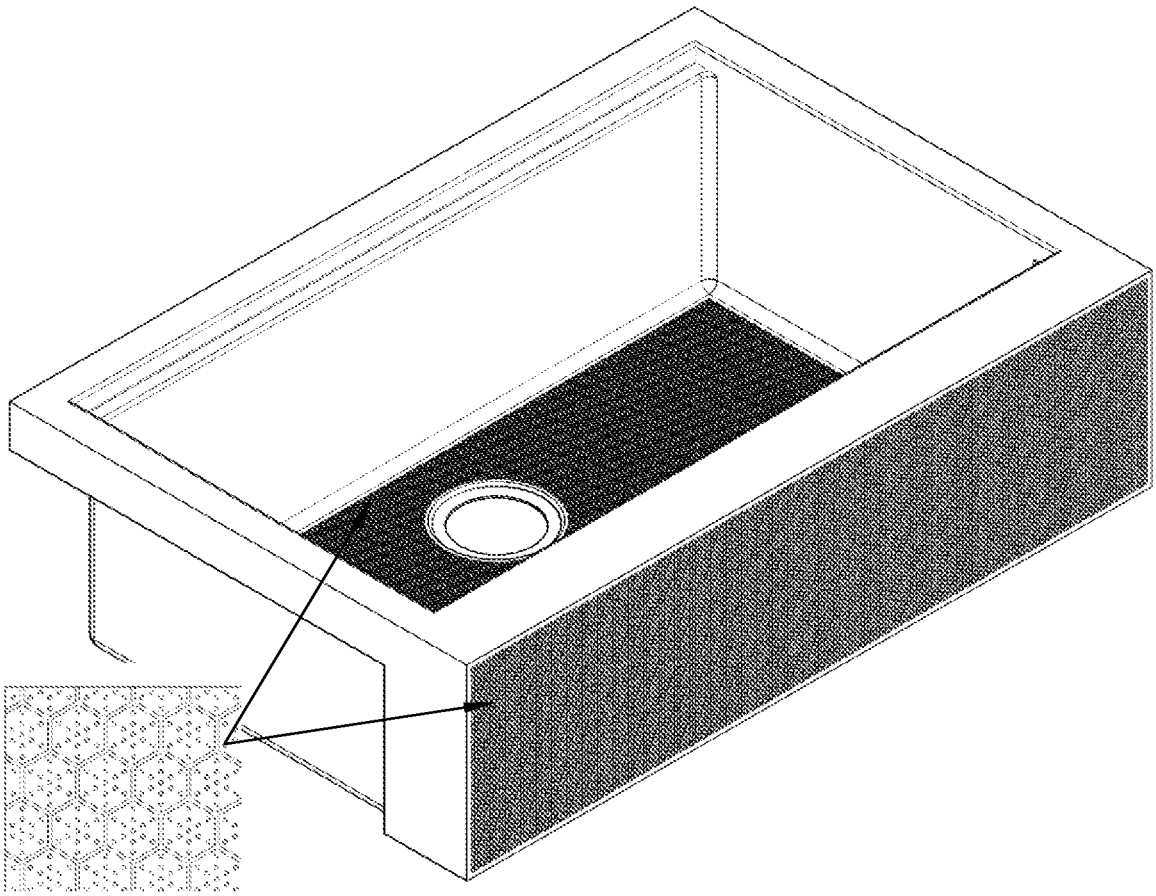
FIG. 4A depicts a top perspective view of an exemplary SEPSS.
Figure 4B:
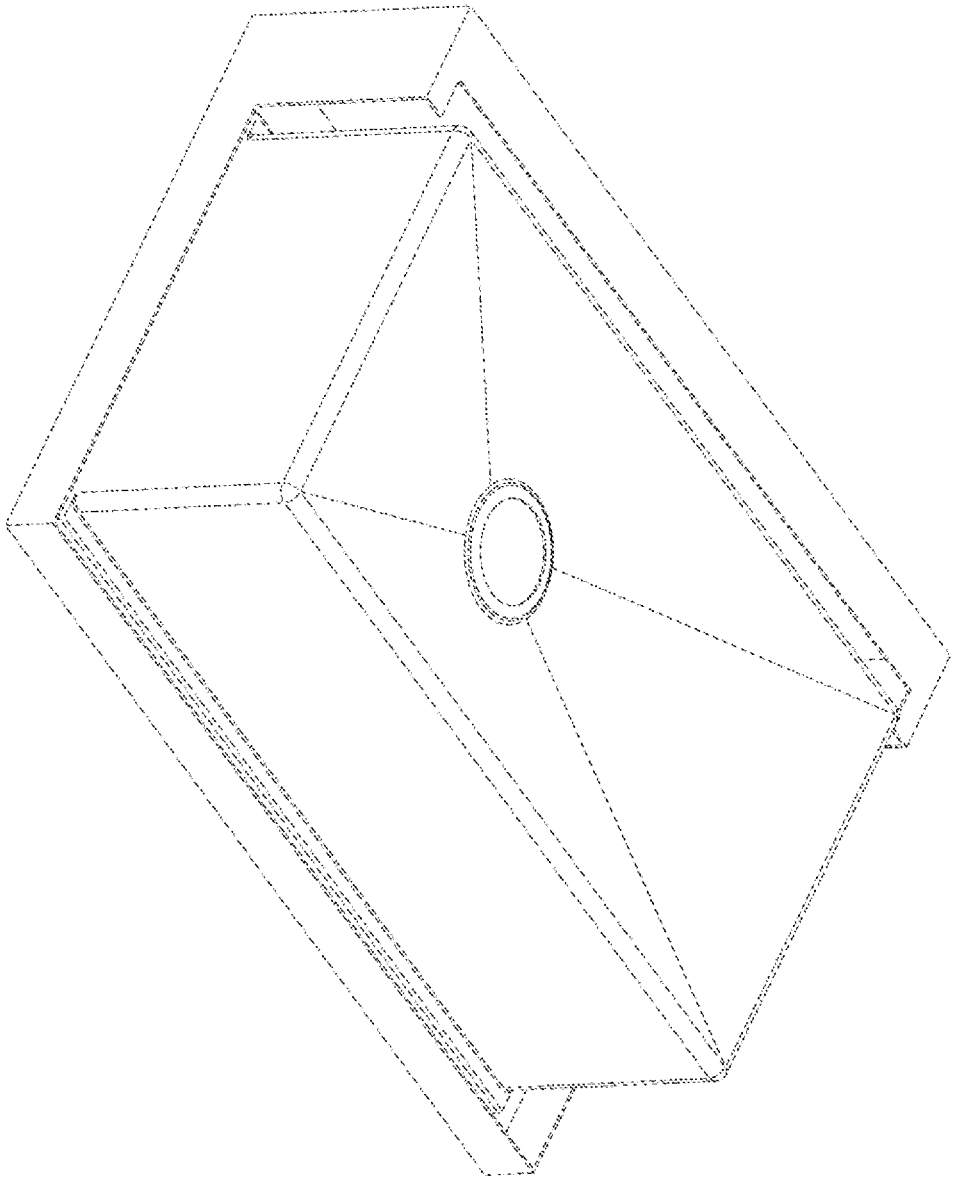
FIG. 4B depicts a bottom perspective view of an exemplary SEPSS.
Figure 4C:
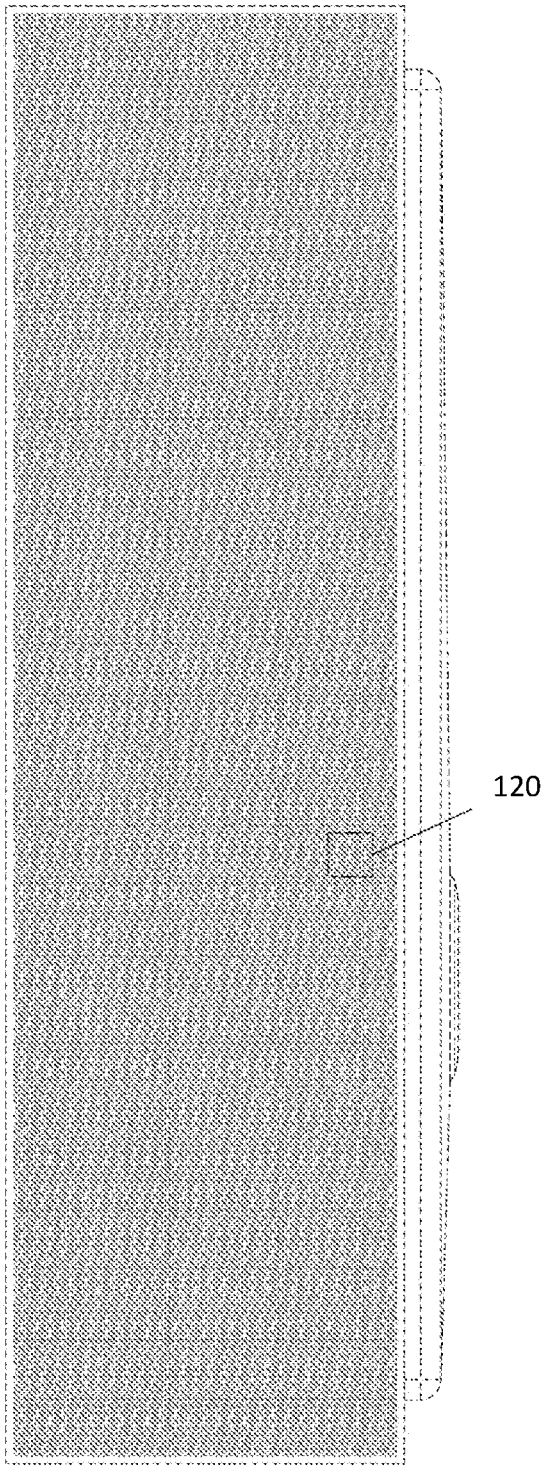
FIG. 4C depicts a front view of an exemplary SEPSS with varying dimensions.
Figure 4D:
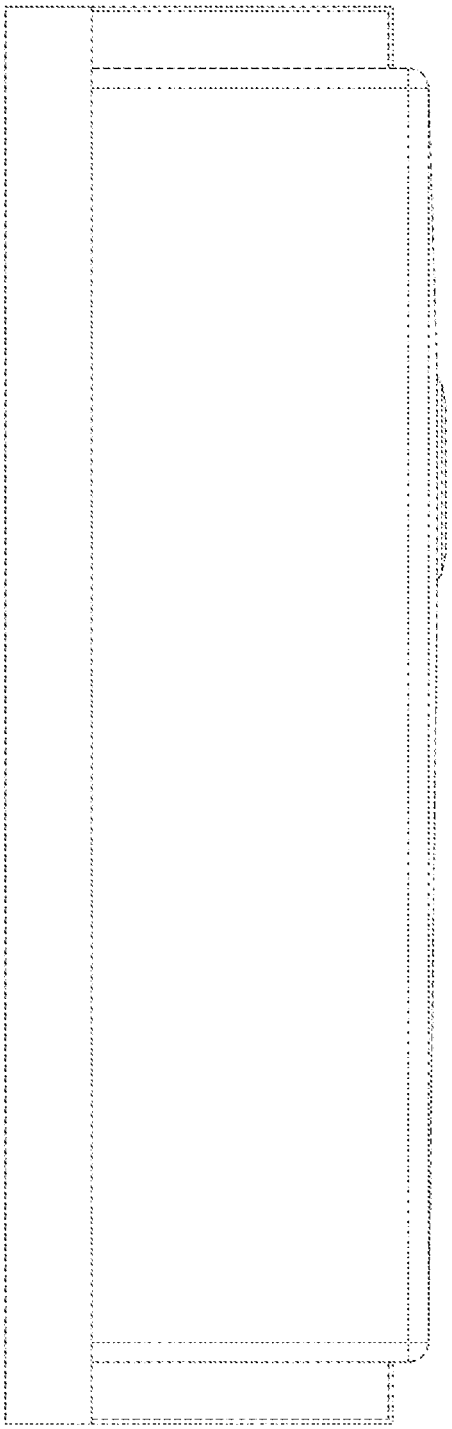
FIG. 4D depicts a back perspective view of an exemplary SEPSS.
Figure 4E:
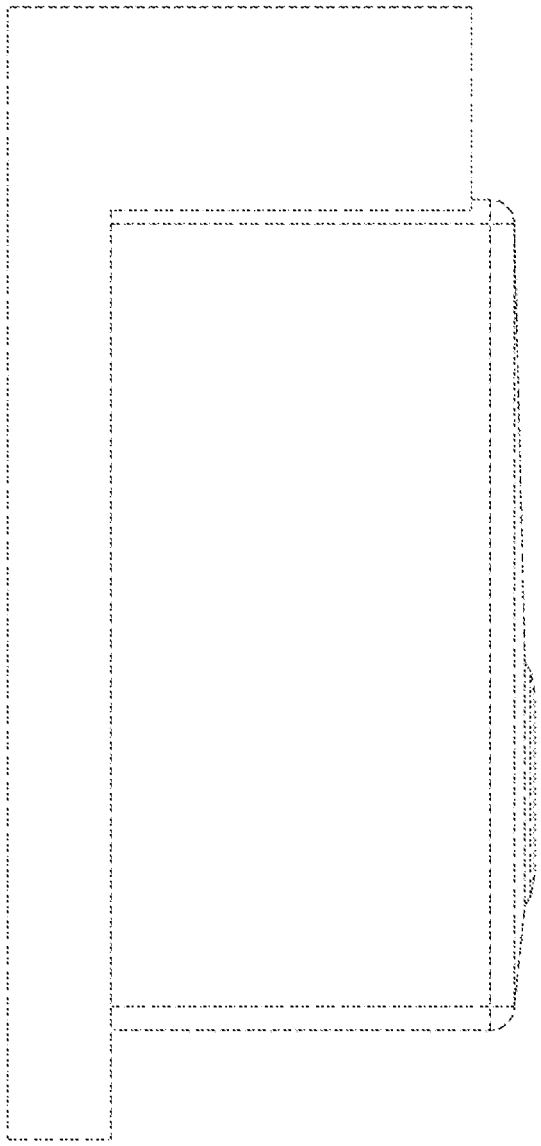
FIG. 4E depicts a left side view of an exemplary SEPSS.
Figure 4F:
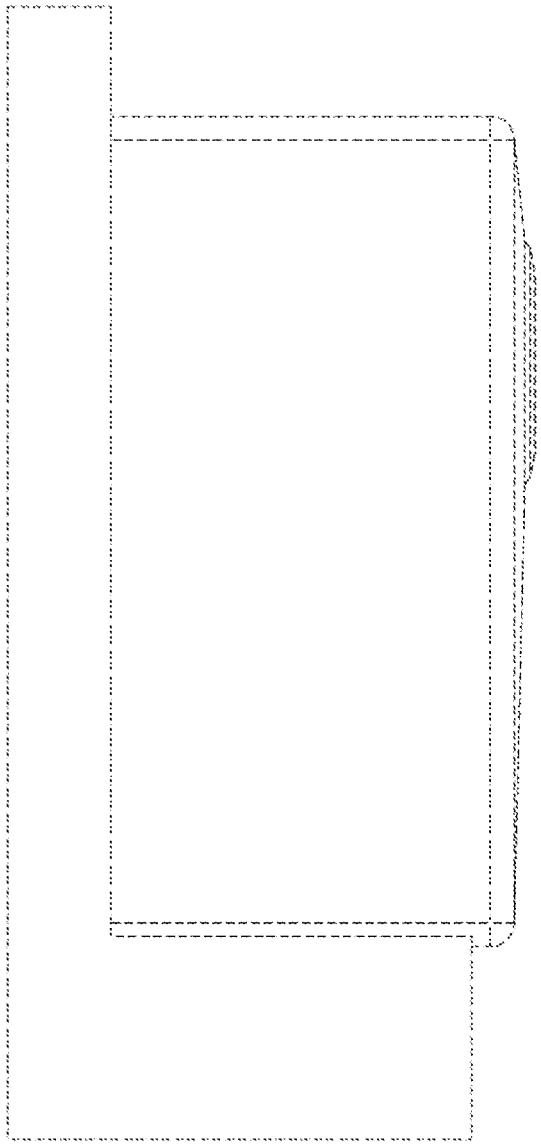
FIG. 4F depicts a right-side view of an exemplary SEPSS.
Figure 4G:
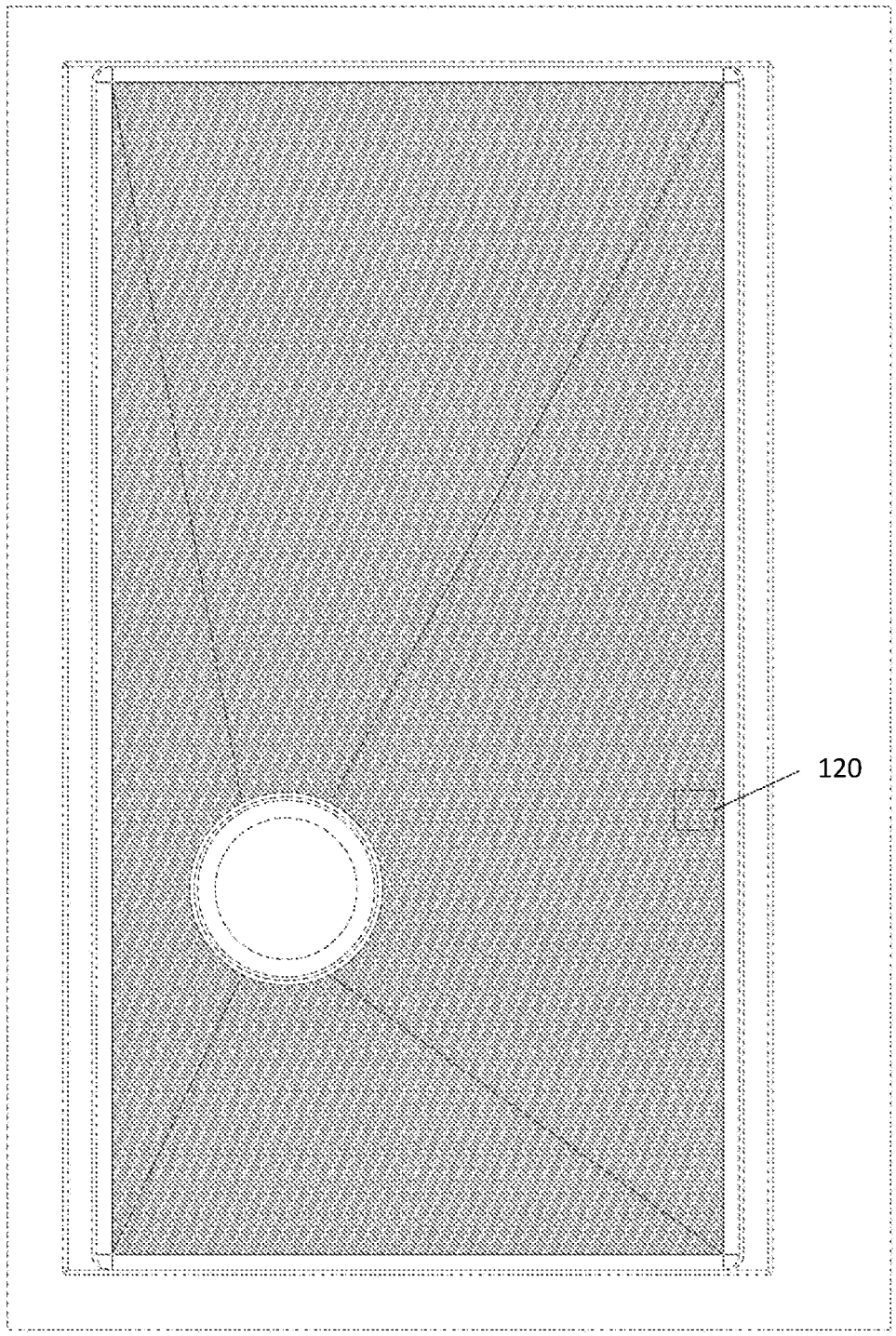
FIG. 4G depicts a top view of an exemplary SEPSS.
Figure 4H:
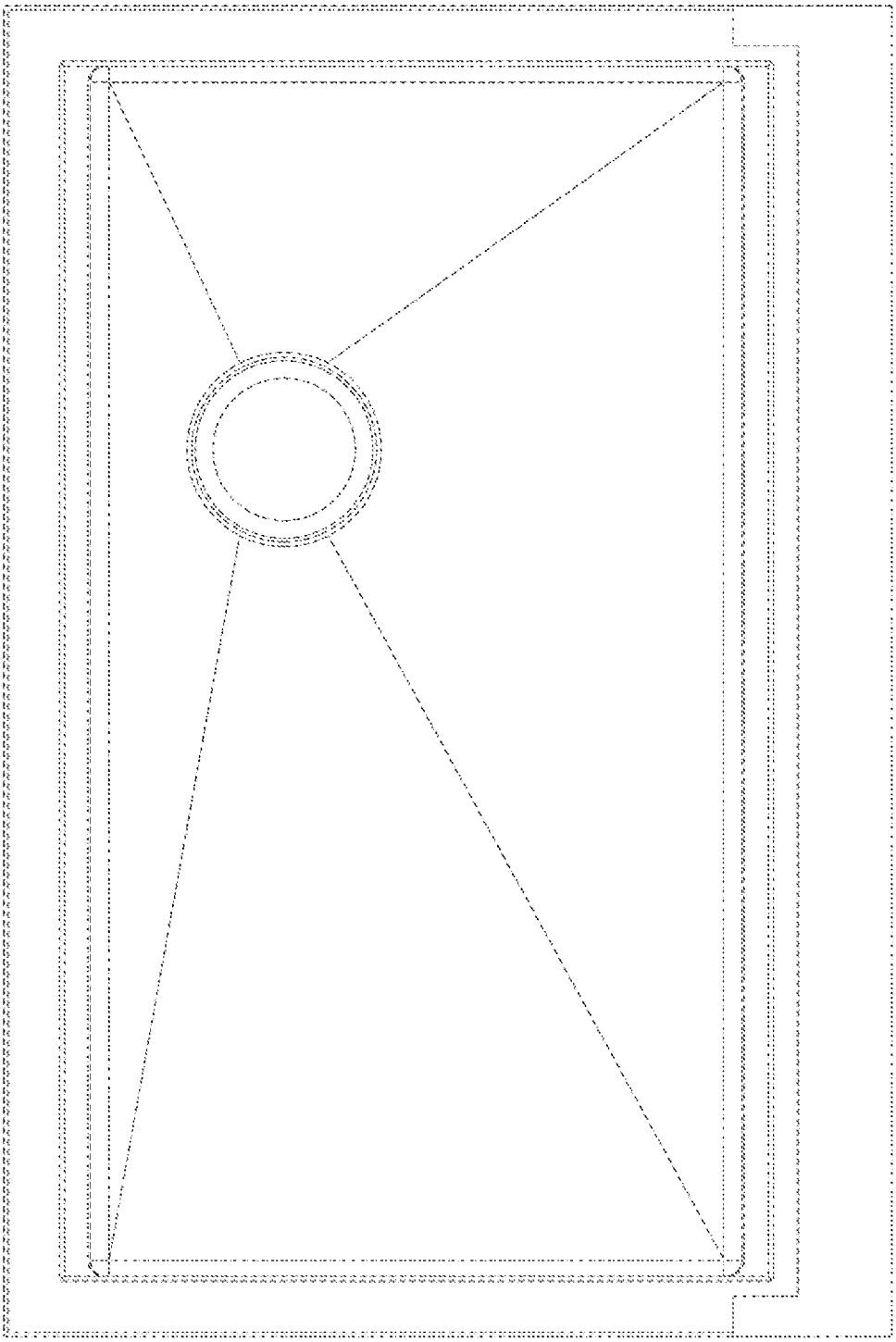
FIG. 4H depicts a bottom view of an exemplary SEPSS.

To aid understanding, this document is organized as follows. First, to help introduce discussion of various embodiments, an exemplary stratified elevation protective sink surface (SEPSS) is introduced with reference to FIGS. 1A-1D. Second, that introduction leads into a description with reference to FIGS. 2A-4H of some exemplary embodiments of the SEPSS. Third, with reference to FIGS. 5-6, this document describes exemplary apparatus and methods useful for manufacturing a SEPSS.

FIGS. 1A-1D depicts an exemplary use case scenario of a stratified elevation protective sink surface (SEPSS) employed in an illustrative use-case scenario 100. The illustrative use-case scenario 100 includes a user 105. The illustrative use-case scenario 100 includes a faucet 110. The illustrative use-case scenario 100 includes a sink 115. Sink 115 includes an exemplary stratified elevation protective sink surface (SEPSS 120).

The stainless-steel sink has a patterned bottom including a pattern of raised features surrounding depressed cavities. The cavities have raised features within them (e.g., raised dots or bumps or protrusions). By stratifying the elevation of the bottom of the sink surface, the stainless-steel sink prevents continuous engagement of a utensil (e.g., knife, fork, pot, pan) from scratching across the bottom of the sink.

Accordingly, the pattern of raised features prevents a continuous scratch being formed in the bottom of the sink. For example, the pattern of raised features in the stainless-steel sink may create patterns of shadows to optically obscure minor scratches. For example, a raised honeycomb (e.g., hexagonal) stratified layer may, for example, enclose a depressed cavity, wherein the depressed cavity includes raised dimples in a dimple pattern. The patterns of raised features in the stainless-steel sink may, for example, reduce an area of possible engagement by supporting utensils above a depressed floor of the cavities, preventing the bottom of the cavities from being scratched.

In the illustrative use case scenario 100, user 105 dropped a pan 125 the user was cleaning into the sink. The pan 125 impacts an impact location 130*a*. The impact location 130*a* may, for example, resist scratches due to the SEPSS grid suspending the pan off of the bottom of the sink and/or interrupting contact with the bottom of the sink. The honeycomb layer is raised from the surface of the sink. Within the honeycomb layer there is the surface of the sink. Within the honeycomb layer there is a set of raised protrusions. The set of raised protrusions may, for example, be in the form of a pattern, (e.g., 3 intersecting lines separated evenly from each other). Accordingly, for example, the SEPSS grid may advantageously reduce or eliminate the creation of long (e.g., visible) scratches onto the bottom of the sink.

A close-up view 130 of the impact location 130*a* is depicted. The close-up view of the impact location includes a section of the pan 125*a*. The close up-view 130 includes a motion A where the pan slides across the surface of the sink. The close up-view 130*a* includes the SEPSS 120. The SEPSS 120 includes a first layer along the longitudinal axis. The first layer may, for example, be formed by the raised features of the SEPSS pattern. The SEPSS includes a second layer 135*a*. The second layer may, for example, be the bottom layer of the sink. The SEPSS pattern may, for example, include 2 or more layers. The SEPSS pattern may, for example, include 3 layers.

In some embodiments, the SEPSS pattern may, for example, include a multilayer of raised features have different dimensions. For example, the three intersecting lines may, for example, include alternative sized protrusions. The pattern may, for example, include gaps between the raised features, and/or protrusions. The gaps between the raised features may, for example, prevent long scratches.

In some embodiments the SEPSS pattern may, for example, be formed by chemical etching. A stencil may be applied to a target surface of the stainless-steel sink. Etching chemicals (e.g., acid) may be applied to exposed stainless-steel surfaces via apertures in the stencil. The chemical etching may create crisp, clean edges of texture by creating cavities and corresponding raised features (e.g., cell walls, ridges, bosses). In some embodiments the SEPSS pattern may, for example, be formed by chemical etching. A stencil may be applied to a target surface of the stainless-steel sink. Etching chemicals (e.g., acid) may be applied to exposed stainless-steel surfaces via apertures in the stencil. The chemical etching may, for example, advantageously create crisp, clean edges of texture by creating cavities and corresponding raised features (e.g., cell walls, ridges, bosses).

The SEPSS 120 includes a border 120*a* on the perimeter of the sink. A smooth border and/or trim may be left around an edge of the sink with no etching or pattern. The border may, for example, promote uninterrupted flow of water draining towards the interior of the sink. In some examples, unetched channels may be left to a drain aperture. A border around the drain may, for example, be left unetched for a pleasing aesthetic and/or unimpeded draining of water and/or a smooth sealing surface for a drain and/or stopper. In some examples, the pattern may be formed by mechanical embossing.

Water 110*a* flows from faucet 110. As the water 110*a* comes in contact with the SEPSS the water flow changes to a controlled flow 110*b*. The illustrative use-case scenario 100 includes an impact area 130*a* in sink. The water from the controlled flow 120*b* may, for example, flow over the raised honeycomb pattern of the SEPSS to the sink.

FIG. 2A-2H top perspective view of an exemplary sink 200 with various illustrative dimensions. The sink 200 includes a varying length 205. The length of the sink may, for example, be 1 ft. The length of the sink may, for example, be 2 ft. The length of the sink may, for example, be 3 ft. The width of the sink may, for example, vary. The height may, for example, be 8 inches. The height may, for example, be 1 ft. The height may, for example, be 16 inches. The width of the sink may, for example, be 8 inches. The width of the sink may, for example, be 1 ft. The width of the sink may, for example, be 1.5 ft. The width of the sink may, for example, be 1.8 ft. The width in some embodiment may, for example, be 2 ft.

FIG. 3A-4H depicts views of an exemplary SEPSS. The SEPSS may, for example, be applied to the front portion of the sink. The front surface may, for example, serve as a grip for the front of the sink. The front surface may, for example, include ornamental designs.

In some embodiments, the pattern may, for example, include a honeycomb structure. In some embodiments, the pattern may, for example, include a circular structure. In some embodiments, the pattern may, for example, include a hexagonal structure. In some embodiments, the pattern may, for example, include a triangular structure. In some embodiments, the pattern may, for example, include a pentagonal pattern. In some embodiments, the pattern may, for example, include a rectangular pattern. In some embodiments, the pattern may, for example, include a square structure. In some embodiments, the pattern may, for example, include irregular shapes.

Figure 5:
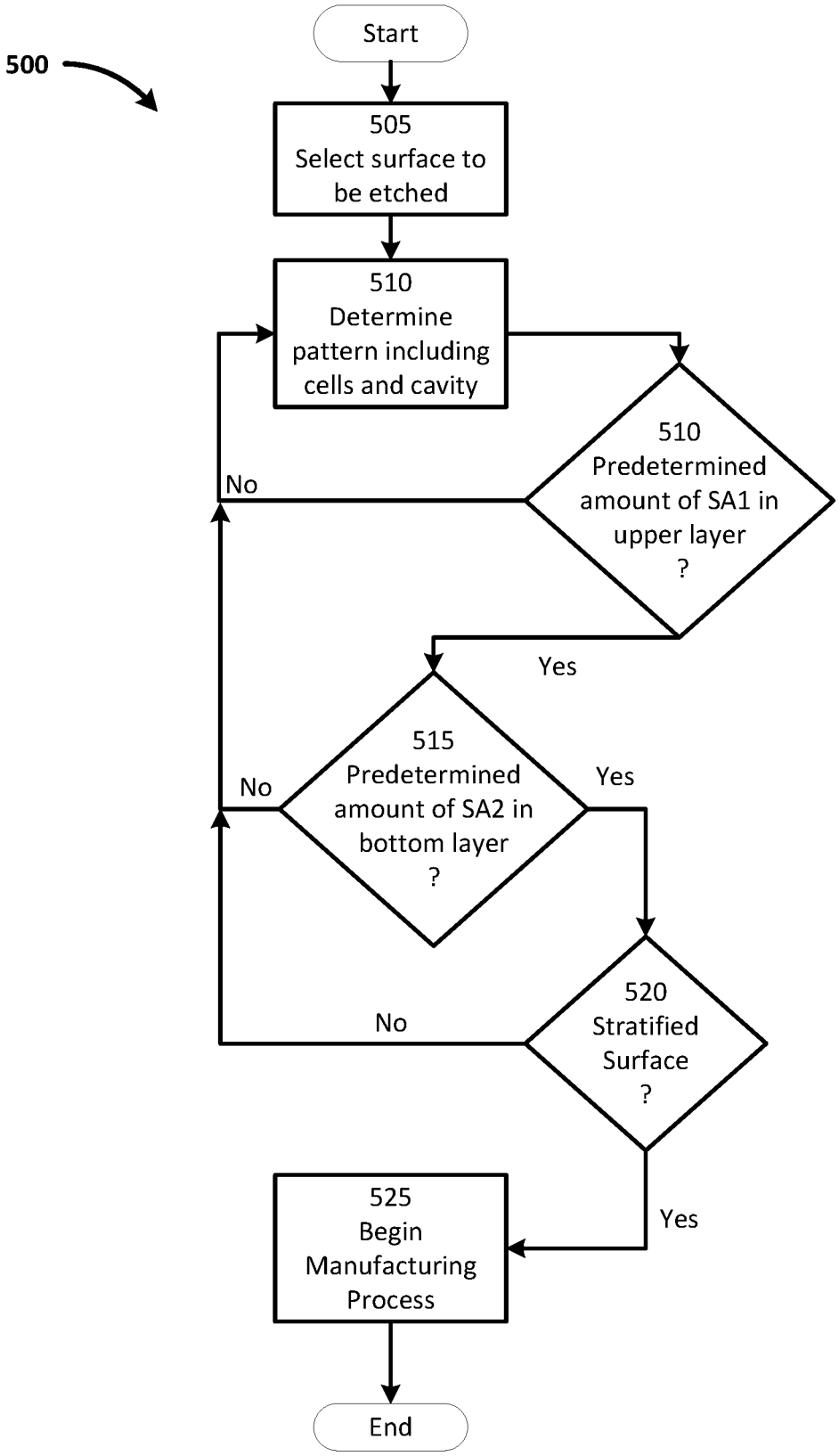
FIG. 5 is a flowchart illustrating an exemplary method of determining the etching pattern for a SEPSS.

FIG. 5 is a flowchart illustrating an exemplary method 500 of a user determining the etching pattern for a SEPSS. The user of the method may, for example by way of example and not limitation, be a person, a machine, software, artificial intelligence, and/or an entity which uses the method. The method may, for example, be used by a machine being operated by a person. The method may, for example, be used by a machine being operated by software. The method may, for example, be operated by a machine and be operated by artificial intelligence. The user may, for example, be a computer processor. The user may, for example, be a computer controller.

In step 505, a user selects a surface to be etched. The surface may, for example, be the bottom of the sink. The surface may, for example, be the front of the sink. In step 510, the user determines the pattern to be used in the cells and cavity. The pattern may, for example, be three dimensional. The pattern may, for example, be honeycomb shaped. The pattern may, for example, contain regular shapes. The pattern may, for example, include irregular shapes.

In step 510, the user determines whether the amount of surface area in the upper layer meets a predetermined amount. The predetermined amount may, for example, be 50%. The predetermined amount may, for example, be 40%. The predetermined amount may, for example, be 30%. The predetermined amount may, for example, be 60%. The predetermined amount may, for example, be greater than 50%. If the criterion is not met, the method returns to step 510, such as, for example, to redetermine a new pattern (e.g., including the cells and/or cavity).

In step 515, the user determines whether the predetermined amount of surface area 2 in the bottom layer is met. If the criterion is not met, the method returns to step 515. For example, at step 515 a new pattern may be determined such as, for example, including the cells and/or cavity.

In some implementations, by way of example and not limitation, the predetermined amount may, for example, be 20%. The predetermined amount may, for example, be 30%. The predetermined amount may, for example, be 15%. The predetermined amount may, for example, be less than 20%.

In step 520, it is determined if the surface is stratified. The stratification of the surface may, for example, prevent continuous engagement of a utensil (e.g., knife, fork, pot, pan) from scratching across the bottom of the sink. If the criterion is not met, then the method returns to step 520. At step 520, a new pattern may, for example, be determined (e.g., including the cells and/or cavity). In step 525, after the stratified surface is determined, the manufacturing process may begin.

Figure 6:
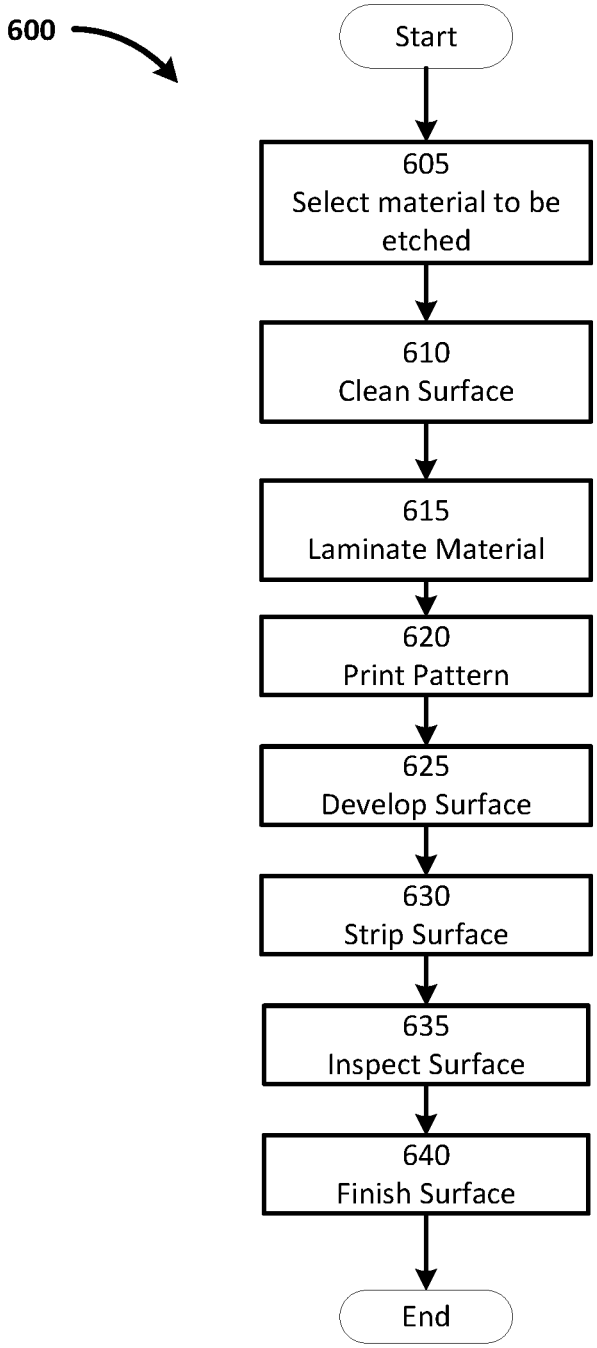
FIG. 6 is a flowchart illustrating an exemplary etching process to manufacture the SEPSS.

FIG. 6 is a flowchart illustrating an exemplary etching process 600 to manufacture the SEPSS. The user of the method may, for example by way of example and not limitation, be a person, a machine, software, artificial intelligence, and/or an entity which uses the method. The method may, for example, be used by a machine being operated by a person. The method may, for example, be used by a machine being operated by software. The method may, for example, be operated by a machine and be operated by artificial intelligence. The user may, for example, be a computer processor. The user may, for example, be a computer controller.

In step 605, a user determines the material to be etched. The user of the method may, for example, select the appropriate metal for etching based on the desired properties and application. Copper may, for example, be used for its antimicrobial properties. Stainless steel may, for example, be used for its corrosion resistance and strength. Aluminum alloy may, for example, be used for its lightweight and cost-effectiveness. Titanium may, for example, be used for its exceptional durability and corrosion resistance. Various plating may, for example, be used to enhance surface properties.

In step 610, the user chemically cleans the metal such that grease on the metal is removed. The cleaning should remove any debris, waxes, and/or rolling oils. The cleaning process may, for example, ensure the metal surface is optimally prepared for the etching process, with the cleanliness necessary to avoid any interference with the adhesion and effectiveness of the photoresist.

In step 615, the user laminates the metal. The laminate material may, for example, be a light-sensitive photoresist. For context, the photoresist may, for example, be used to form the mask that will dictate the etching pattern. The photoresist may, for example, be applied uniformly across the metal surface using adhesives. Adhesive may, for example, be applied to the laminate material to couple it to the sheet. Quality control sensors may, for example, be included to determine a blemish free laminate layer.

In step 620, the user prints the pattern on the sheet. This may, for example, be accomplished by exposing the metal to ultra-violent (UV) light. The UV light may, for example, interact with the chemicals create a protective pattern.

In step 625, the user develops the sheet. The sheet may, for example, be developed by removing the unexposed photoresist. This may, for example, reveal the raw material. The hardened resist may, for example, protect parts of the etching during the next step of chemical treatment.

In step 630, the user etches the metal. The etching may, for example, include an etchant chemical such as ferric chloride. The chemical may, for example, be sprayed onto the developed sheet. The etch time may, for example, be determined by accounting variables such as metal type, grade, thickness, and/or size.

In step 635, strip the photoresist from the sheet. The photoresist may, for example, protected the pattern during the etching process. The thorough removal of photoresist may, for example, ensure no residues interfere with the quality assessments.

In step 640, inspect the dimension and visual patterns of the sheet. Determined that the surface meets the desired quality.

In step 645, finish the SEPSS surface. Additional manufacturing such as plating, forming, and/or plating may, for example, be added to the SEPSS surface.

In some embodiments, the first continuous elevated pattern etching height may, for example, be between 0.05 inches and 0.30 inches. The height may, for example, be 0.2 inches. The height of the first continuous elevated pattern etching height may, for example, prevent direct contact between utensils and the protective surface and non-continuous elevated pattern etching (e.g., protrusions), thus mitigating wear and tear. In some implementations, the height may, for example, be less than 0.05 inches.

In some embodiments, the width of each continuous first elevated pattern may, for example, include a dimension of about 0.05 inches to 0.25 inches. The width may, for example, include 0.2 inches. The width of the elevated pattern may, for example, provide a robust structure that effectively shields the underlying surface. In some implementations, the width may be less than 0.05 inches. In some implementations, the width may be greater than 0.25 inches.

In some embodiments, the first continuous elevated pattern etching may, for example, covers at least 80% of the protective surface of the sink. The first continuous elevated pattern etching may, for example, covers at least 60% of the protective surface of the sink. The first continuous elevated pattern etching may, for example, covers at least 80% of the protective surface of the sink, the first continuous elevated pattern etching may, for example, covers the entirety of the protective surface of the sink. The sink may, for example, have a dimension of 20 inches by 18 inches. The sink may, for example, have a dimension of 24 inches by 18 inches. The sink may, for example, have a dimension of 30 inches by 24 inches. The sink may, for example, have varying heights, widths, and/or heights.

In some embodiments, the height of the second non-continuous elevated pattern etching may, for example, be between 0.05 inches-0.2 inches. The height may, for example, include 0.15 inches. The height may, for example, be less having a height differential compared to the first etching. The height differential may, for example, allow for subtle elevation differences that may, for example, protect against scratches while maintaining an aesthetic quality.

In some embodiments, the width of each protrusion may, for example, include a dimension between 0.01-0.15 inches. The width of the protrusions may, for example, be designed to minimize contact with potential scratching objects while not obstructing water flow or cleaning processes.

In some embodiments, the spacing between individual protrusions in the second non-continuous pattern may, for example, include a dimension of between 0.01 inch to 0.15 inches. The spacing may, for example, be aligned such that at least one protrusion is included in each polygon of the first layer. The spacing may, for example, be configured such that protrusions are included in some polygons, but not all polygons. This spacing may, for example, be optimized to prevent any objects from making extended contact with the sink's base.

In some embodiments, the curvature or edge roundness of each protrusion in the second etching may, for example, be smoothly finished to prevent any sharp edges, enhancing safety during sink use. In some embodiments, the second pattern may, for example, bisects the first continuous pattern along a predetermined number of lines and/or paths. For example, be evenly spaced across the diameter of the sink, integrating aesthetically and functionally with the primary hexagonal pattern.

Although various embodiments have been described with reference to the figures, other embodiments are possible.

Although an exemplary system has been described with reference to FIG. 1A-6, other implementations may be deployed in other industrial, scientific, medical, commercial, and/or residential applications.

In industrial applications, SEPSS can be used in situations where sinks are used frequently and subjected to harsh conditions. The pattern of raised features can protect against scratches and damage from heavy industrial utensils and tools. Additionally, the chemical etching process described for creating these patterns ensures durability and precision, suitable for environments like factories or processing plants where reliability is crucial.

In scientific applications, sinks may, for example, encounter a variety of chemical substances which can erode or damage standard surfaces. The SEPSS's multi-layered, etched design may, for example, provide enhanced resistance to chemical wear, making it ideal for scientific research facilities. The precise patterning might also be used to control fluid dynamics at the sink's surface, beneficial for specific experimental setups involving liquid handling.

In medical applications, hospitals and clinics may, for example, implement SEPSS in their facilities to benefit from its hygienic properties. The raised patterns may, for example, prevent water from stagnating, reducing the risk of bacterial growth. Additionally, the easy-to-clean, scratch-resistant surface would help maintain cleanliness in medical sinks, which are crucial for infection control.

In commercial applications, restaurants, hotels, and/or other businesses in the hospitality industry may, for example, use SEPSS to extend the lifespan of their kitchen equipment. The aesthetic flexibility of SEPSS, e.g., various patterns like polyangular shapes (pentagon, hexagon, octagonal, etc.), honeycomb, and/or circular structures, may, for example, contribute to the interior design elements of commercial kitchens, blending functionality with style.

In residential applications, home kitchens and bathrooms may, for example, benefit from SEPSS due to its protective features that minimize wear and tear from daily use. The ability to customize the pattern and the added aesthetic value can appeal to homeowners looking for durability without compromising on design. The SEPSS's potential to improve water flow and prevent clogging may, for example, enhance everyday convenience in residential settings.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A sink comprising a stratified protective surface extending along at least one face of a sink, the stratified protective surface comprising:

a visually exposed protected stratum;

a continuous pattern protruding from the protected surface, extending across the stratified protective surface, and configured to support cookware elevated from the protected surface; and, an interrupted pattern protruding from the protected surface, extending across the stratified protective surface interspersed with the continuous pattern, wherein the continuous pattern and the interrupted pattern together form an elevated stratum comprising at least thirty percent of a total area of the stratified protective surface.

2. The sink of claim 1, wherein the continuous pattern comprises a hexagonal pattern remaining after etching the stratified protective surface to form the visually exposed protected stratum.

3. The sink of claim 1, wherein the elevated stratum and the visually exposed protected stratum covers at least 80% of the total area of the protective surface.

4. The sink of claim 1, wherein the interrupted pattern comprises protrusions each having a surface area in the elevated stratum at least fifty percent of a cross-sectional area at the face.

5. The sink of claim 4, wherein the surface area in the elevated stratum is at least eighty percent of the cross-sectional area at the face.

6. The sink of claim 1, further comprising:

walls intersecting with the stratified protective surface to form an intersecting area; and a predetermined border along the protective surface extending from the intersecting area to the continuous pattern.

7. The sink of claim 1, wherein the interrupted pattern comprises protrusions configured to have a flat uppermost surface.

8. The sink of claim 7, wherein protrusions of the interrupted pattern further comprise a predetermined spacing between protrusions.

9. A sink comprising a stratified protective surface extending along at least one face of a sink, the stratified protective surface comprising:

a visually exposed protected stratum; and, a pattern protruding from the protected surface to form an elevated stratum extending across the stratified protective surface, and configured to support cookware elevated from the protected surface;

wherein the elevated stratum comprises at least thirty percent of a total area of the stratified protective surface;

wherein the elevated stratum comprises a continuous pattern protruding from the protected surface, extending across the stratified protective surface; and, a second pattern protruding from the protected surface extending across the stratified protective surface and interspersed with the continuous pattern.

10. The sink of claim 9, wherein the second pattern protruding further comprises:

an interrupted pattern.

11. The sink of claim 10, further comprising:

walls intersecting with the stratified protective surface to form an intersecting area; and a predetermined border along the protective surface extending from the intersecting area to the continuous pattern.

12. The sink of claim 10, wherein the interrupted pattern comprises protrusions configured to have a flat uppermost surface.

13. The sink of claim 12, wherein protrusions of the interrupted pattern further comprise a predetermined spacing between protrusions.

14. The sink of claim 10, wherein the continuous pattern comprises a hexagonal pattern remaining after etching the stratified protective surface to form the visually exposed protected stratum.

15. The sink of claim 14, wherein the interrupted elevated pattern extends along three lines bisecting the hexagonal pattern.

16. The sink of claim 10, wherein the interrupted pattern comprises protrusions each having a surface area in the elevated stratum at least fifty percent of a cross-sectional area at the face.

17. The sink of claim 16, wherein the surface area in the elevated stratum is at least eighty percent of the cross-sectional area at the face.

18. The sink of claim 10, wherein the continuous pattern comprises a circular pattern.

19. The sink of claim 10, wherein the continuous pattern comprises a predetermined graphic.

20. The sink of claim 9, wherein the visually exposed protected stratum comprises an etched depressed pattern of the stratified protective surface.

* * * * *